US008181789B1

(12) United States Patent
Casella et al.

(10) Patent No.: US 8,181,789 B1
(45) Date of Patent: May 22, 2012

(54) RETAIL PACKAGING FOR TRANSACTION CARDS

(75) Inventors: Michael L. Casella, Glendale, CA (US); Steven W. Streit, Pasadena, CA (US); Eduardo A. Becerril, Lynwood, CA (US); Mark Timothy Troughton, Los Angeles, CA (US); R. Matthew Kohler, San Francisco, CA (US)

(73) Assignee: Green Dot Corporation, Monrovia, CA (US)

( * ) Notice: Subject to any disclaimer, the term of this patent is extended or adjusted under 35 U.S.C. 154(b) by 0 days.

(21) Appl. No.: 12/696,742

(22) Filed: Jan. 29, 2010

(51) Int. Cl.
*A45C 11/00* (2006.01)

(52) U.S. Cl. ..... 206/768; 206/471; 206/779; 206/39.7

(58) Field of Classification Search ..... 206/449, 206/454, 39, 469, 467, 470, 471, 767, 768, 206/775, 779, 462, 831, 39.7
See application file for complete search history.

(56) References Cited

U.S. PATENT DOCUMENTS

| | | | | | |
|---|---|---|---|---|---|
| D42,210 | S | | 2/1912 | Hoch | |
| 4,804,984 | A | * | 2/1989 | Heuer et al. | 206/316.2 |
| 5,740,915 | A | | 4/1998 | Williams | |
| 5,760,381 | A | | 6/1998 | Stich | |
| 5,777,305 | A | | 7/1998 | Smith | |
| 5,842,629 | A | * | 12/1998 | Sprague et al. | 229/71 |
| D411,765 | S | | 7/1999 | Holihan | |
| 5,918,909 | A | | 7/1999 | Fiala | |
| 5,975,302 | A | * | 11/1999 | Young | 206/449 |
| 5,984,091 | A | * | 11/1999 | Orr et al. | 206/232 |
| 6,109,439 | A | | 8/2000 | Goade, Sr. | |
| 6,224,108 | B1 | | 5/2001 | Klure | |
| 6,315,206 | B1 | | 11/2001 | Hansen | |
| 6,349,829 | B1 | * | 2/2002 | Matheis et al. | 206/449 |
| 6,457,649 | B1 | | 10/2002 | Hileman | |
| 6,732,459 | B1 | | 5/2004 | Clark | |
| 6,957,737 | B1 | | 10/2005 | Frederickson | |
| D512,456 | S | | 12/2005 | Diaz | |
| D532,452 | S | | 11/2006 | Heng | |
| 7,494,056 | B2 | | 2/2009 | Sturm | |
| 2003/0150762 | A1 | | 8/2003 | Biller | |
| 2006/0027663 | A1 | | 2/2006 | Tang | |
| 2006/0186011 | A1 | * | 8/2006 | Palmer | 206/461 |
| 2006/0255154 | A1 | | 11/2006 | Newbrough | |
| 2006/0278551 | A1 | * | 12/2006 | Bianchini et al. | 206/463 |
| 2007/0252009 | A1 | | 11/2007 | Kingsborough | |
| 2007/0278293 | A1 | | 12/2007 | Anderson | |
| 2008/0237317 | A1 | | 10/2008 | Rosendall | |

* cited by examiner

*Primary Examiner* — Jacob K Ackun
(74) *Attorney, Agent, or Firm* — Bryan Cave LLP

(57) ABSTRACT

Retail packaging for a transaction card includes a carrier for retaining the transaction card, a transparent encasement enclosing the carrier, literature containing information associated with the transaction card placed within the encasement, and means for hanging the packaging within a retail environment. The encasement may take on a variety of forms, including having a curved outer surface forming a cavity within the encasement. The carrier may also take on a variety of forms, including forms having a main surface and a device for elevating the transaction card off the main surface to create a visual effect that the transaction card is floating within the encasement. The packaging may further include a panel that at least partially obscures the transaction card from view.

8 Claims, 25 Drawing Sheets

RETAIL PACKAGING FOR TRANSACTION CARDS

FIELD OF THE INVENTION

This invention relates generally to improvements in retail packaging and display technology related to the sale of transaction cards.

BACKGROUND OF THE INVENTION

Open loop association-branded transaction cards (e.g., cards issued or sponsored by MasterCard, VISA, American Express, Discover, and others), stored value cards, gift cards, bankcards, co-branded and affinity cards, debit cards, and the like, may be sold in a retail setting. As is known, many of these cards contain a variety of information to identify the card, account related text, data, indicia and features on the surface of the cards such as card issuer identification, brand information, account activation indicia, and card number information. This information may also be encoded within a magnetic strip attached to a surface of the card. Transaction cards of the type described herein may be sold in a retail setting and commonly are packaged in or on some form of a carrier or other protective packaging. Many of these transaction cards are offered in an inactive state and, therefore, must be activated prior to usage. Typically, activation is performed at the time of sale and requires access to the card's magnetic strip or variable data barcode, commonly specified by the particular retailer.

Studies conducted by the assignee of the present invention have demonstrated that consumer interest and purchase intent increases significantly through showing the transaction card and/or portions of the indicia or brand information on the card on display. However, in an effort to discourage or prevent theft and/or fraud, it is common for transaction cards to be displayed for sale in packages in which the cards are fully enclosed to completely obscure viewing of the card.

A need exists, therefore, for an improved retail packaging assembly for transaction cards which permits the viewing of the front of the transaction card while maintaining sufficient security. A preferred solution would balance brand recognition and desired security associated while ensuring the packaging contains sufficient technology to be used in a retail environment.

SUMMARY OF THE INVENTION

According to one aspect of the present invention, packaging for transaction card includes a carrier for retaining the transaction card, a transparent encasement enclosing the carrier, literature containing information associated with the transaction card placed within the encasement, and means for hanging the packaging within a retail environment. The encasement may take on a variety of forms, including having a curved outer surface forming a cavity within the encasement. The carrier may also take on a variety of forms, including forms having a main surface and a device for elevating the transaction card off the main surface to create a visual effect that the transaction card is floating within the encasement. The packaging may further include a panel that at least partially obscures the transaction card from view.

According to another aspect of the present invention, packaging for a transaction card includes a protective encasement having a front shell and a mating back shell, wherein the back shell includes a cutout forming an opening when the front shell is mated with the back shell in a closed condition. A carrier for retaining the transaction card is placed within the encasement. Preferably, carrier has a main panel having a flap foldable over the main panel, with the main panel and the flap being enclosed within the protective encasement. The carrier also includes a rear panel and a hinge panel attaching the rear panel to the main panel. The hinge panel preferably extends through the opening such that the rear panel is located outside of the encasement. The transaction card may be affixed to the main panel with the flap being smaller than the main panel such that when the flap is in a folded position the flap obscures a portion of the transaction card.

In another embodiment, the packaging for a transaction card includes a rear panel, an inner sheet having an opening attached to the rear panel, a shell housing the transaction card and partially residing within the opening (with the shell adhered to the rear panel and the inner sheet) and a flap panel foldably attached to the rear panel such that when the flap panel is in a folded position the flap panel obscures a portion of the transaction card.

In another embodiment, the packaging for a transaction card includes a rear panel and a front panel having an opening, wherein the front panel is at least partially adhered to the rear panel such that the transaction card is held between the front and rear panels and wherein at least a portion of the transaction card is visible through the opening in the front panel.

In another embodiment, the packaging for a transaction card includes a multi-panel carrier comprising a rear panel, a front panel, and a central panel, wherein both the central panel and the front panel are foldably attached to the rear panel. The packaging further includes a protective encasement housing the carrier and a pouch for retaining the transaction card attached to the central panel. Preferably, the pouch is sized smaller than the transaction card to permit a portion of the transaction card to be viewed. In this embodiment, the front panel has an opening and the central panel folds onto the rear panel and the front panel folds onto the central panel so that the pouch partially extends through the opening in the front panel.

In yet another embodiment, the packaging for a transaction card includes a front panel having an opening, a rear panel adhered to the front panel, and a transparent shell for housing the transaction card. Preferably, the shell has a cavity formed to fit within the opening of the front panel such that the transaction card may be placed within the cavity. The packaging may also include a screen sized to fit within the cavity of the shell in front of the transaction card to partially obscure the transaction card from view.

BRIEF DESCRIPTION OF THE FIGURES

These and other features, aspects and advantages of the invention will become more fully apparent from the following detailed description, appended claims, and accompanying drawings, wherein the drawings illustrate features in accordance with exemplary embodiments of the present invention, and wherein:

DETAILED DESCRIPTION OF THE INVENTION

Figure 1:
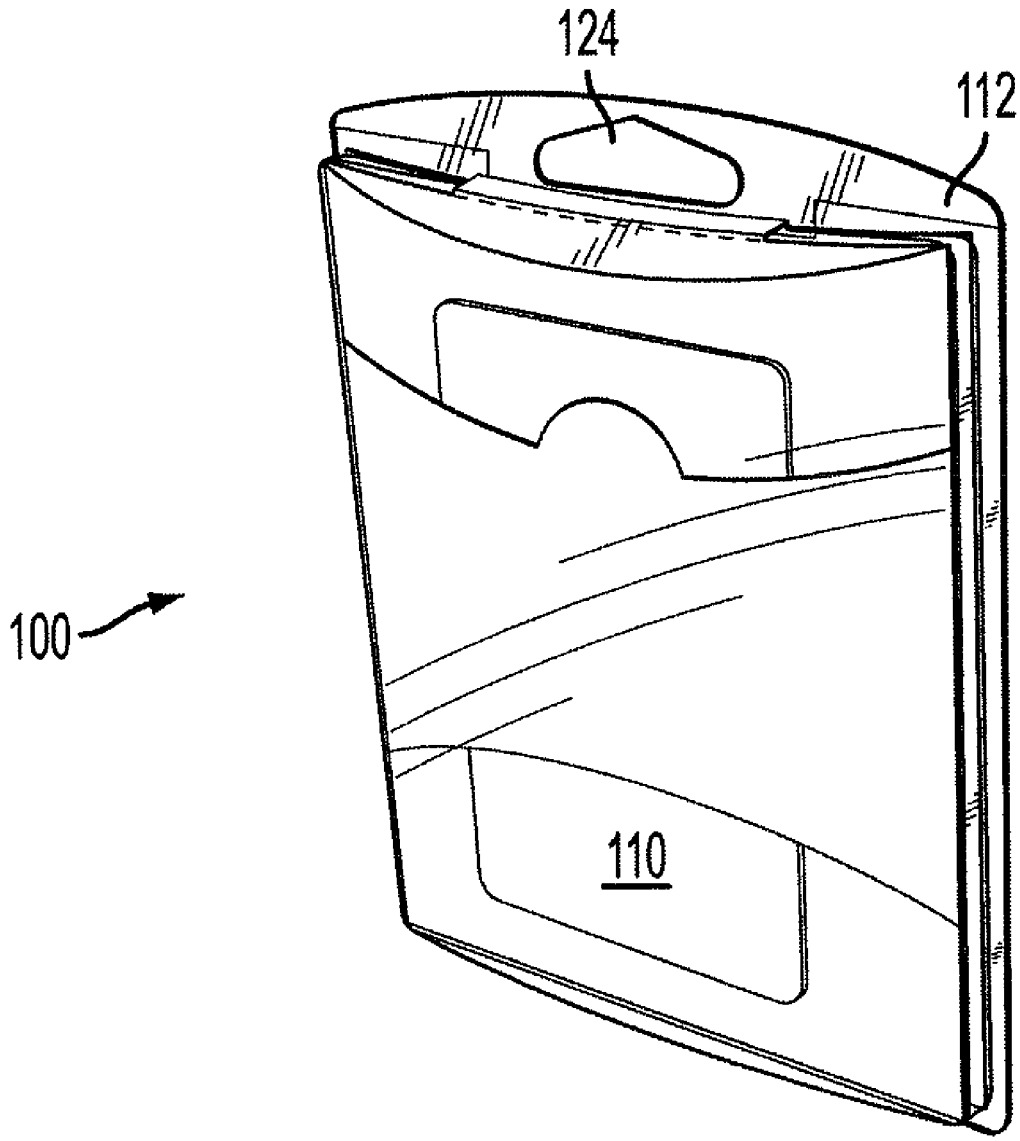
FIG. 1 is front perspective view of the packaging for a transaction card in accordance with one embodiment of the present invention.
Figure 2:
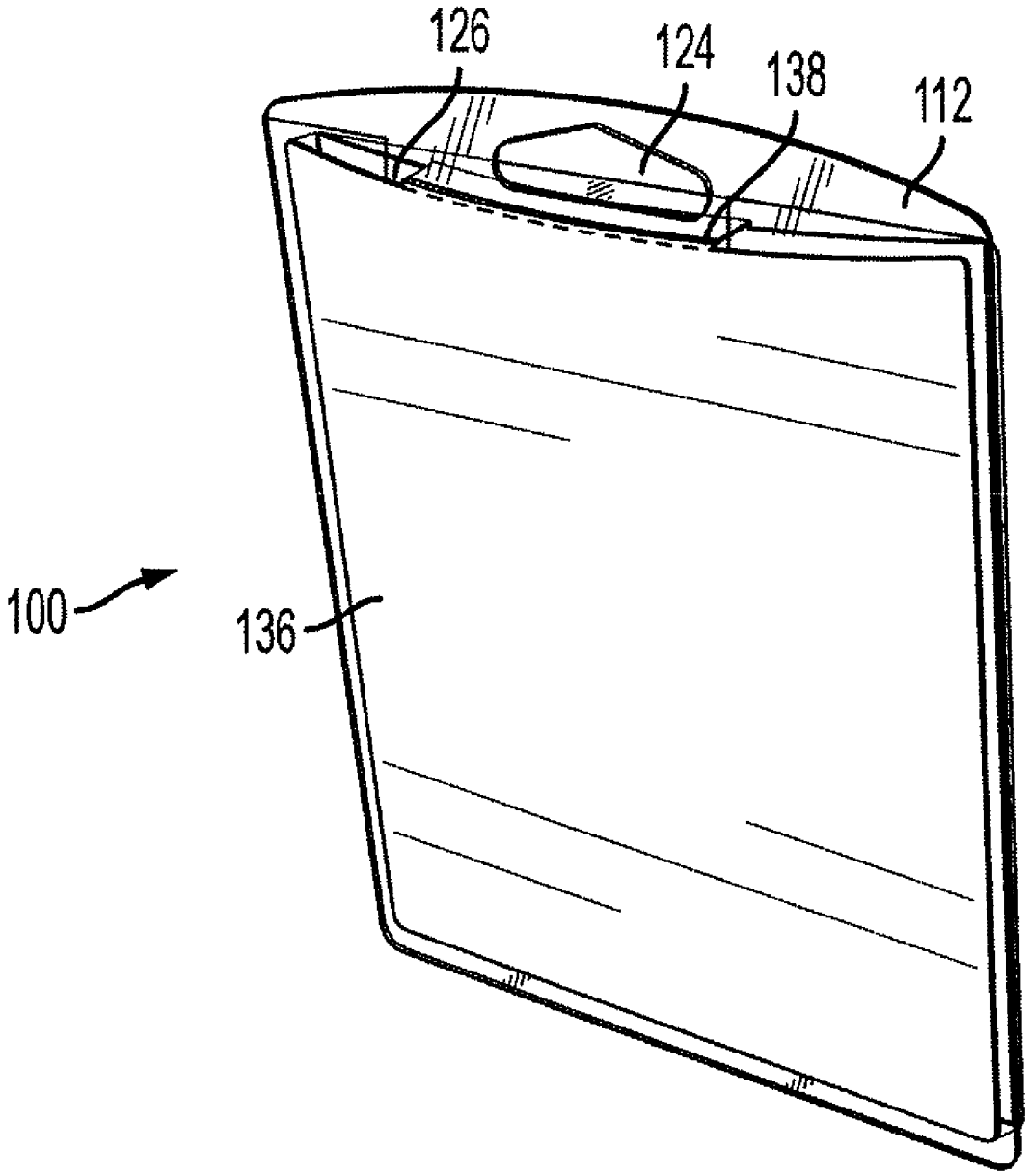
FIG. 2 is a rear perspective view of the packaging of FIG. 1.

FIGS. 1-5 illustrate one embodiment of the retail packaging 100 for securely housing a transaction card 110. In this embodiment, packaging 100 includes a two-piece clamshell-type protective encasement 112, including a front shell 114 and a mating back shell 116. The protective encasement 112 is adapted to encapsulate or hold a transaction card 110, various forms of literature or instructional material, and carrier 118. The encasement 112 is preferably formed from clear, see-through or frosted plastic, although other forms are within the scope of the present invention. The encasement 112 is preferably sealed along its peripheral margin, for example, using a heat bond, an adhesive seal, a RF laser-based seal, UV heat glue, or other means customary in the packaging industry. The sealed encasement 112 provides protection against tampering and pilferage of the enclosed transaction card 110. The encasement 112 may be sized as desired for retail display and security purposes.

The front shell 114 of the encasement 112 may be curved (for example, along the horizontal dimension) to create a visual perception of package depth. For example, the encasement 112 when in a fully closed position may be about 5-7 mm in depth at the left and right peripheral edges and about 10-12 mm at the center. Preferably, the front shell 114 mates with the back shell 116. For example, the front shell 114 may include an inner edge 120 that snugly engages over a similarly shaped outer edge 122 on the back shell 116. An aperture 124 may be defined in the front shell 114 and/or the back shell 116 for suspending the encasement 112 from a display peg or J-hook.

In certain embodiments, the top portion of the back shell 116 may include a cutout region 126 forming an opening when the front shell 114 is mated with the back shell 116 in a closed condition. The opening permits a portion of the carrier 118 to reside outside of the protective encasement 112 as described below. The retail packaging 100 may also include a booklet 128 containing, for example, terms and conditions for use with the transaction card 110. The booklet 128 may be placed in a cavity formed in the inside surface of the back shell 116, which is then concealed from view by the carrier 118. The design of the packaging 100 that permits a small booklet 128 containing all the terms and conditions associated with the transaction card 110 required under disclosures laws and regulations is particularly useful in that it avoids the expense of later mailing out such information to the user. The booklet 128 may contain full or temporary terms and conditions and/or other consumer-related material (how the transaction card works, how to activate it, how to use it, how to reload it, etc.).

Figure 3:
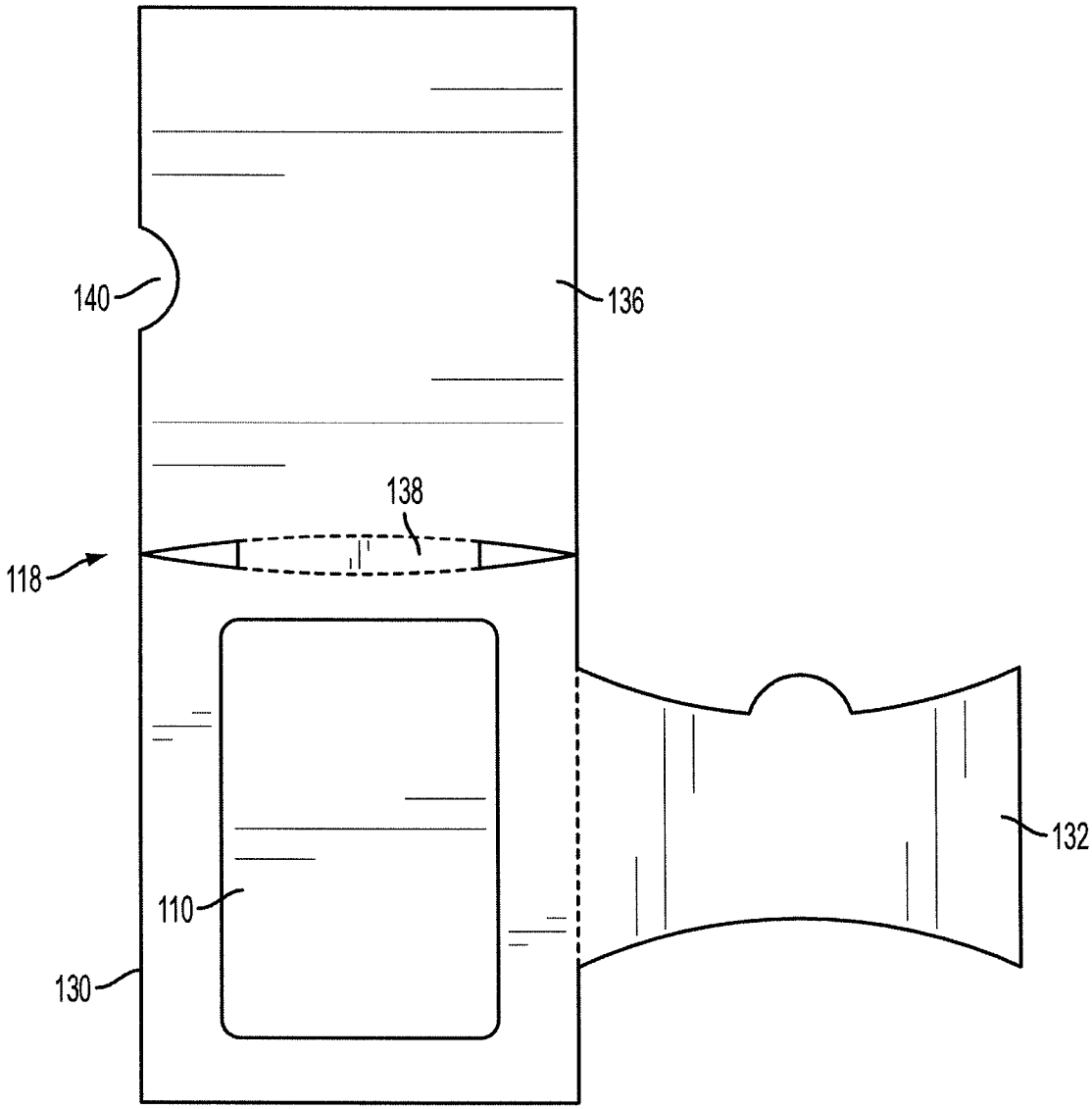
FIG. 3 is a front perspective view of the carrier of the packaging of FIG. 1.
Figure 4:
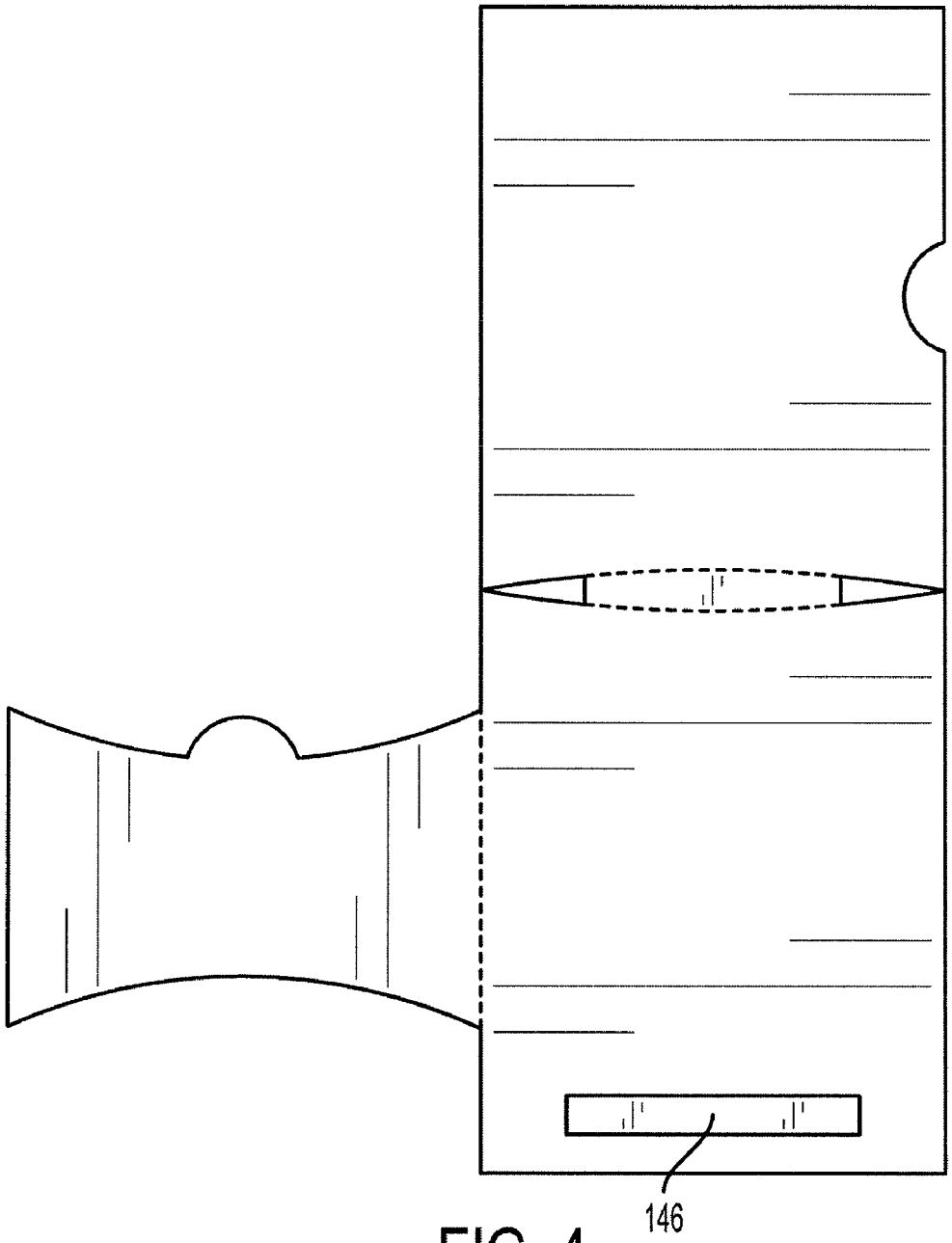
FIG. 4 is a rear perspective view of the carrier of the packaging of FIG. 1.
Figure 5:
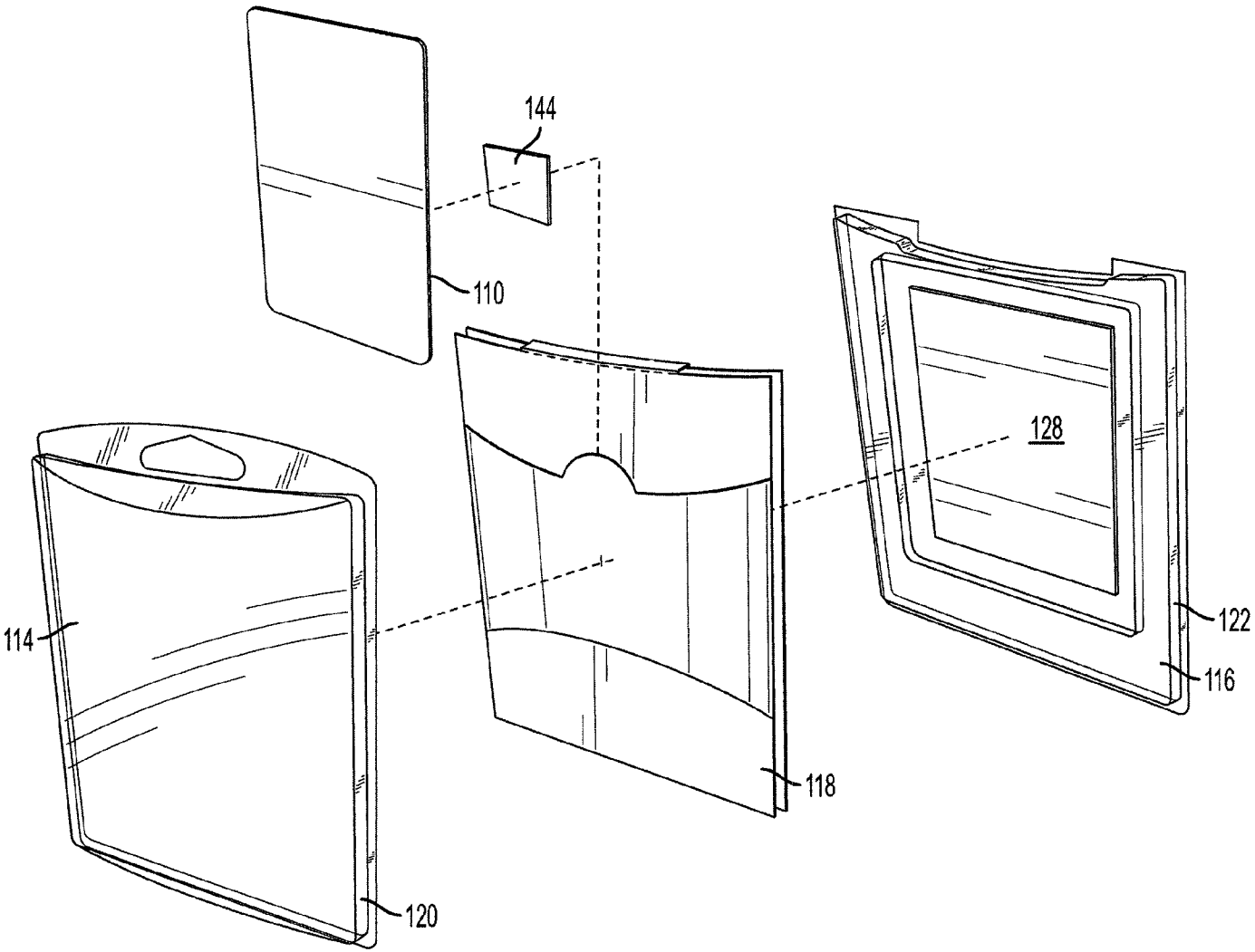
FIG. 5 is an exploded perspective view of the carrier of the packaging of FIG. 1.
Figure 6:
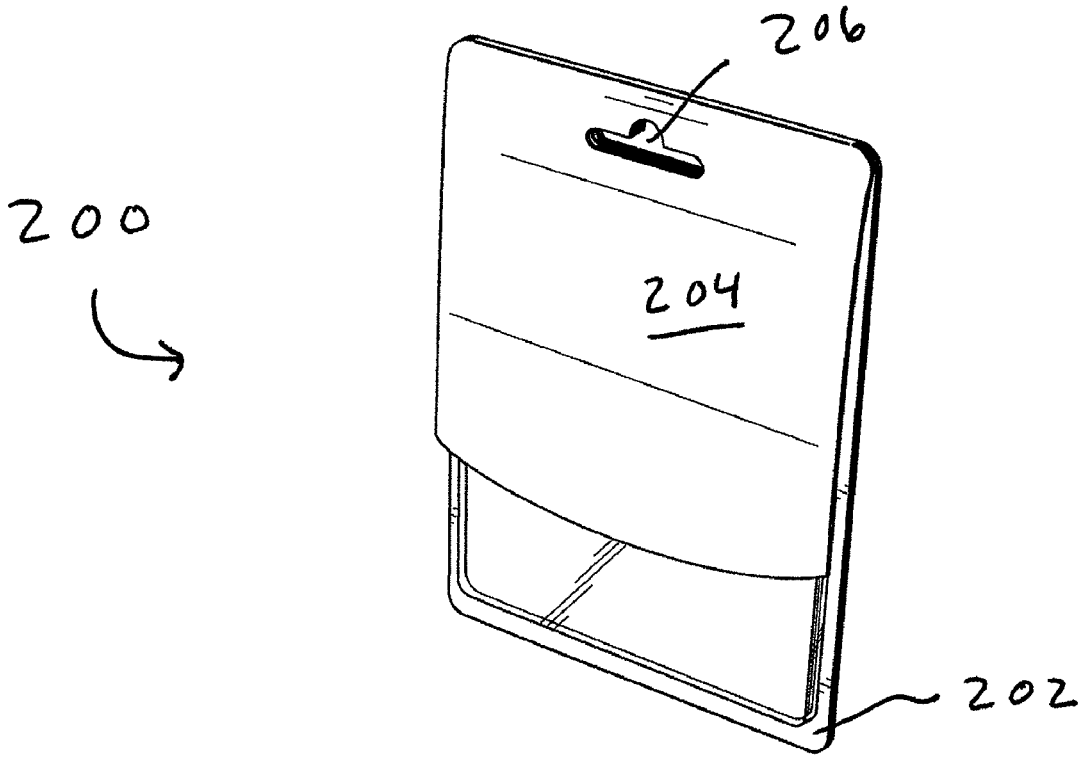
FIG. 6 is a front perspective view of the packaging for a transaction card in accordance with a second embodiment of the present invention.
Figure 7:
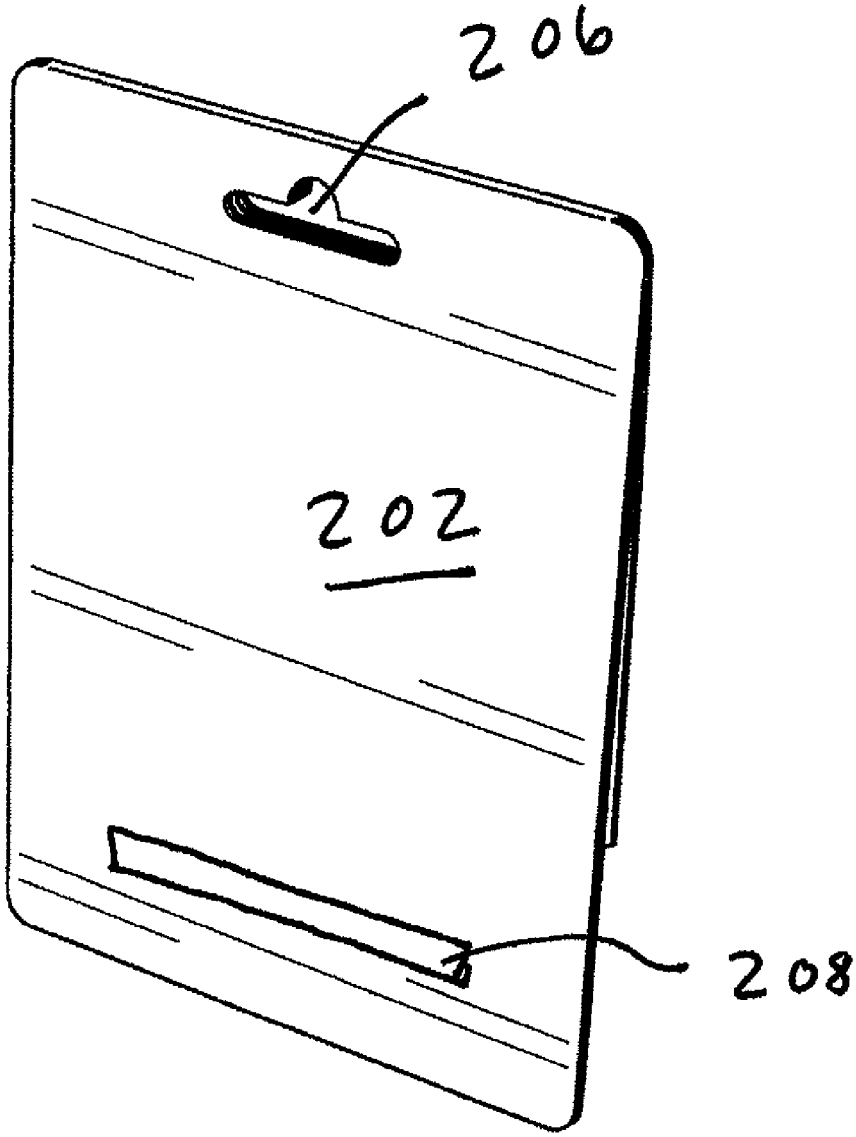
FIG. 7 is a rear perspective view of the packaging of FIG. 6.
Figure 8:
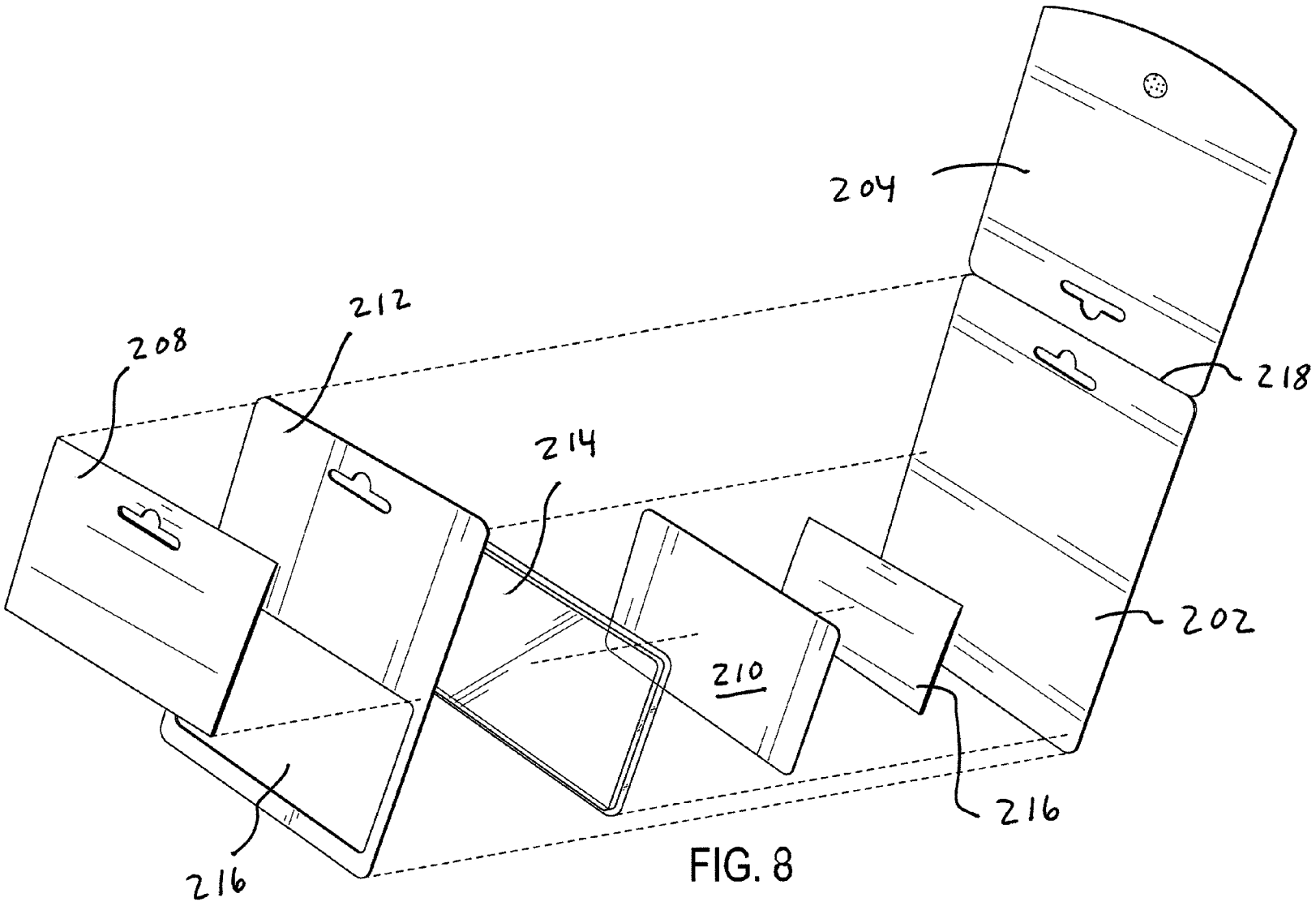
FIG. 8 is an exploded perspective view of the packaging of FIG. 6.
Figure 9:
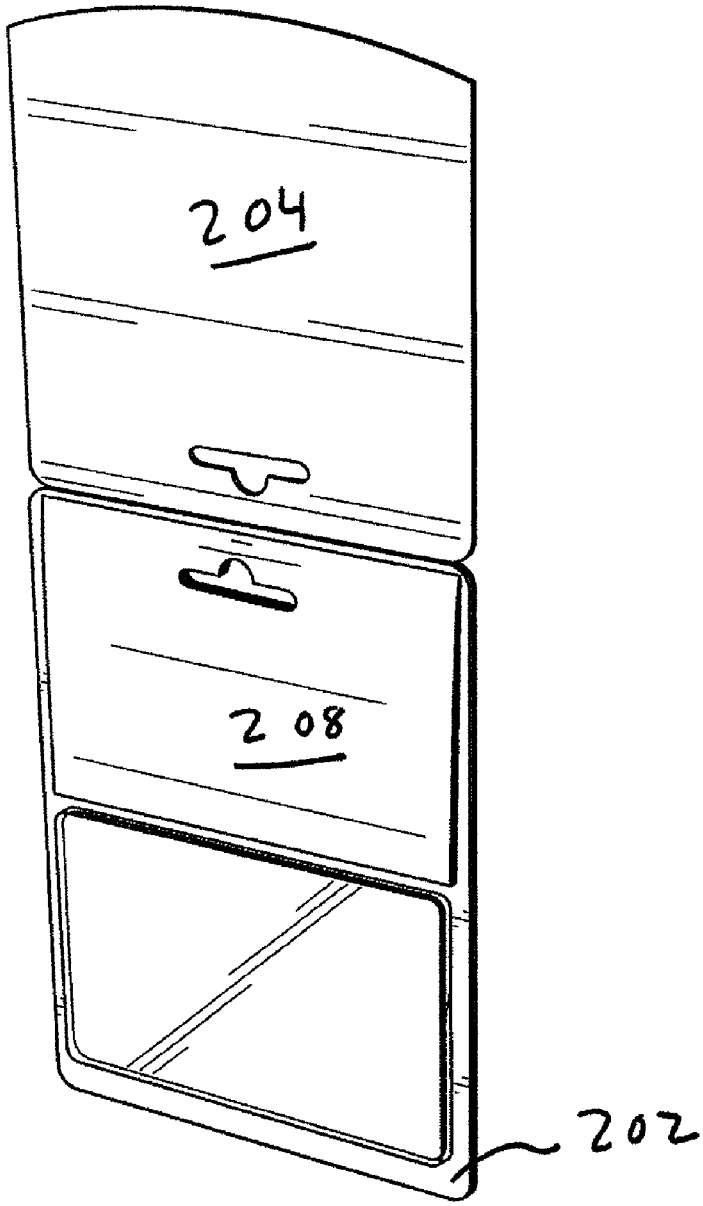
FIG. 9 is another front perspective view of the packaging of FIG. 6.

As best illustrated in FIGS. 3 and 4, the carrier 118 preferably includes four portions. Main panel 130 supports the transaction card 110. For example, the transaction card 110 may be releasably secured to the center portion of the main panel 130 (or offset therefrom) in any suitable manner known in the art, such as by use of a releasable glue or tape product. Preferably, a suspension device 144 is affixed between the transaction card 110 and the main panel 130. The suspension device 144 may be a piece of corrugated paper or foam or similar device that elevates the card 110 off of the main panel 130 to create a visual effect that the transaction card 110 is floating within the packaging 100. Thus, the transaction card 110 may be releasably secured to the suspension device 144 and the device 144 may be affixed to the main panel 130.

Flap 132 folds over along the perforated or scored fold line 134 to cover or obscure portions of the transaction card 110. For example, the flap 132 may be sized, shaped, and/or configured to conceal the card number and expiration date, while allowing visibility to the identification of the card issuer and other indicia on the card 110. As illustrated in FIG. 1, the flap 132 may be configured to conceal the center portion of the card 110, while leaving the left and right sides of the card exposed to viewing. In certain embodiments, the transaction card 110 may include a customer response vehicle label (i.e., a removable sticker) that further conceals certain information contained on the card 110 from view.

Although the carrier 118 may be limited to main panel 130 and flap 132, in certain embodiments, a back panel 136 may be hinged to the main panel 130 by means of hinge panel 138, which extends through the opening in the back shell 116 such that the back panel 136 resides outside of the encasement 112. A potential purchaser of the transaction card 110 may open the back panel 136 using thumb notch 140 to reveal textual information and/or retailer technology on the inside of the back panel 136 or the opposing side of the main panel 130 (which is viewable through the clear back shell 116) to facilitate the retail sale of the transaction card 110. The back panel 136 may be opened in the retail setting prior to purchase of the transaction card 110 to reveal additional information to the potential purchaser without destroying the integrity of the packaging 100. In particular, the information and/or technology revealed by opening up the back panel 136 may include account activation indicia, such as a mag-stripe or variable bar code 146 (and possibly a universal price code), so that the transaction card 110 may be activated at the cash register when the retail package is purchased. In addition, the textual information may include purchasing information, card activation information, advertising information, and other information for the potential purchaser. In embodiments without the hinge panel 138 and the back panel 136, the information and/or technology described above may be contained on the back of the main panel 130 and viewable through the back shell 116. Preferably, the main panel 130 and the back panel 136 are shaped to mate with the size and shape of the front shell 114 and back shell 116 of the encasement 112, with the exception of the peripheral margin. The outside surface of the back shell 116 may also include a recess to retain the back panel 136. The recess may be approximately the thickness of the back panel 136, for example, between about 6-12 mm.

The carrier 118 may be constructed from any suitable materials known in the art such as cardboard, laminated card or sheet stock, or the like. The material for some or all of the panels of the carrier 118 may be in the form of clear foil laminated or adhered to the panels improve the appearance of the packaging 100. Portions of the carrier 118 may contain printed matter, such as brand identification, regulatory information, discretionary advertising, and the like.

FIGS. 6-9 illustrate a second embodiment of the retail packaging 200 for retaining a transaction card 210. The packaging 200 may be adapted to encapsulate, hold, or embody the transaction card 210, along with various forms of literature or instructional material. Although FIGS. 6-9 illustrate the transaction card 210 in a horizontal orientation, it can be appreciated that the card 210 may be placed in other orientations using the packaging 200.

The packaging 200 preferably includes a rear panel 202 having an attached flap panel 204. An inner sheet 212 having an opening 216 may be attached to the inside surface of the rear panel 202. A plastic shell 214 resides within the opening 216 and is attached along it periphery to both the rear panel 202 and the inner sheet 212 to house the transaction card 210 and, optionally, a booklet 216 containing, for example, terms and conditions for use with the transaction card 210. The plastic shell 214 is preferably formed from clear, see-through or frosted plastic, although other forms are within the scope of the present invention. The booklet 216 may be placed in a cavity formed in the inside surface of the plastic shell 214 back shell 116, which is then concealed from view by the transaction card 210. The design of the packaging 200 that permits a small booklet 216 containing all the terms and conditions associated with the transaction card 210 required under disclosures laws and regulations is particularly useful in that it avoids the expense of later mailing out such information to the user. The booklet 216 may contain full or temporary terms and conditions and/or other consumer-related material (how the transaction card works, how to activate it, how to use it, how to reload it, etc.).

A second booklet 208 may be affixed to the outer surface of the inner sheet 212. This second booklet 208 may contain purchasing information, card activation information, advertising information, and other information for the potential purchaser. An aperture 206 may be defined in each of the rear panel 202, the flap panel 204, the inner sheet 212, and the booklet 208 for suspending the packaging 200 from a display peg or J-hook.

The flap panel 204 folds over along the perforated or scored fold line 218 to cover or obscure portions of the transaction card 210. For example, the flap 218 may be sized, shaped, and/or configured to conceal the card number and expiration date, while allowing visibility to the identification of the card issuer and other indicia on the card 210. In certain embodiments, the transaction card 210 may include a customer response vehicle label (i.e., a removable sticker) that further conceals information contained on the card 210 from view.

The front and rear sides of the flap panel 204, as well as the rear side of the rear panel 202, may contain marketing or purchasing information. The rear side of the rear panel 202 may include account activation indicia, such as a mag-stripe or variable bar code 208 (and possibly a universal price code), so that the transaction card 210 may be activated at the cash register when the retail package is purchased.

The rear panel 202, flap panel 204, and inner sheet 212 may be constructed from any suitable materials known in the art such as cardboard, laminated card or sheet stock, or the like. The material for some or all of the rear panel 202, flap panel 204, and inner sheet 212 may be in the form of clear foil laminated or adhered to the panels improve the appearance of the packaging 200. Portions of the rear panel 202, flap panel 204, and inner sheet 212 may contain printed matter, such as brand identification, regulatory information, discretionary advertising, and the like.

Figure 10:
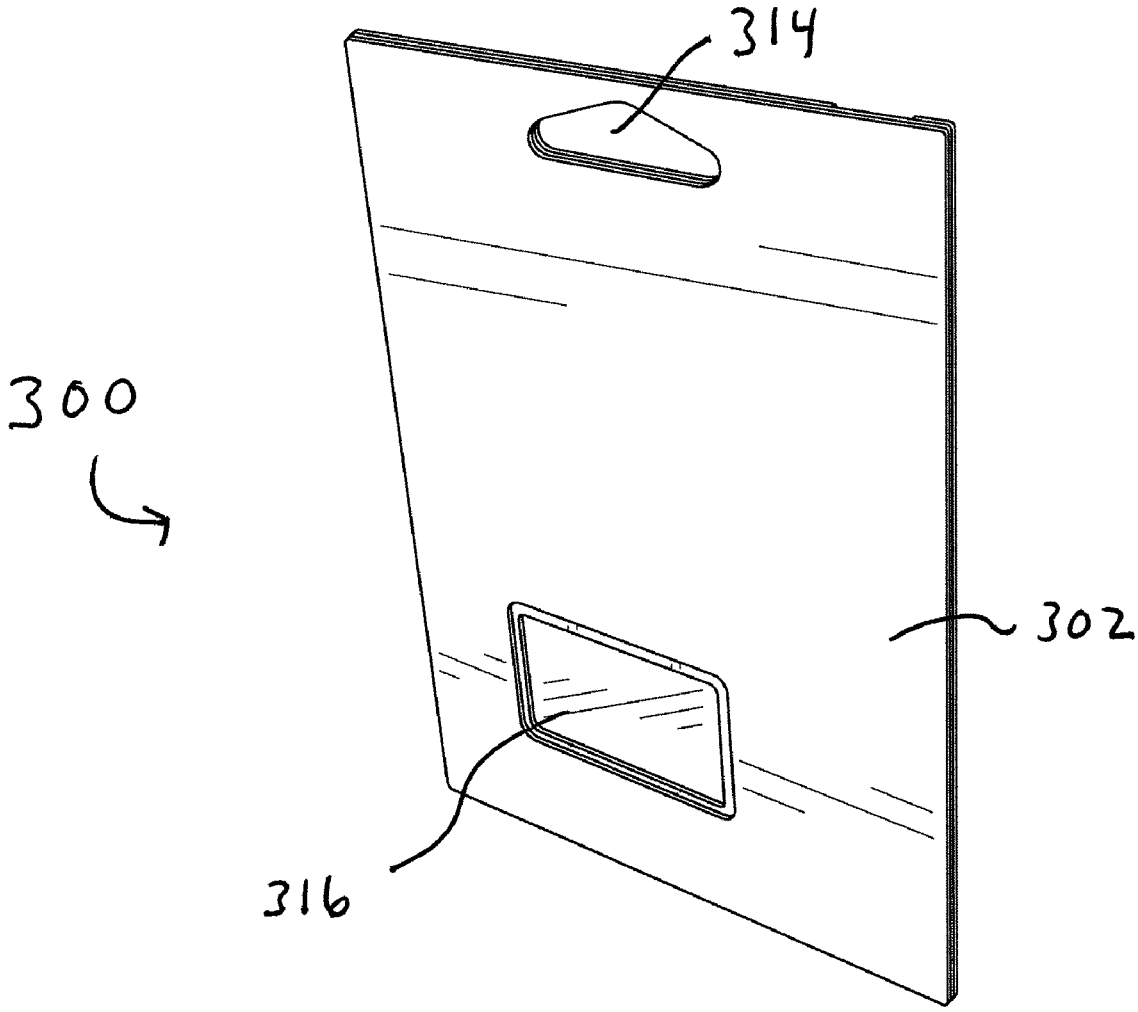
FIG. 10 is a front perspective view of the packaging for a transaction card in accordance with a third embodiment of the present invention.
Figure 11:
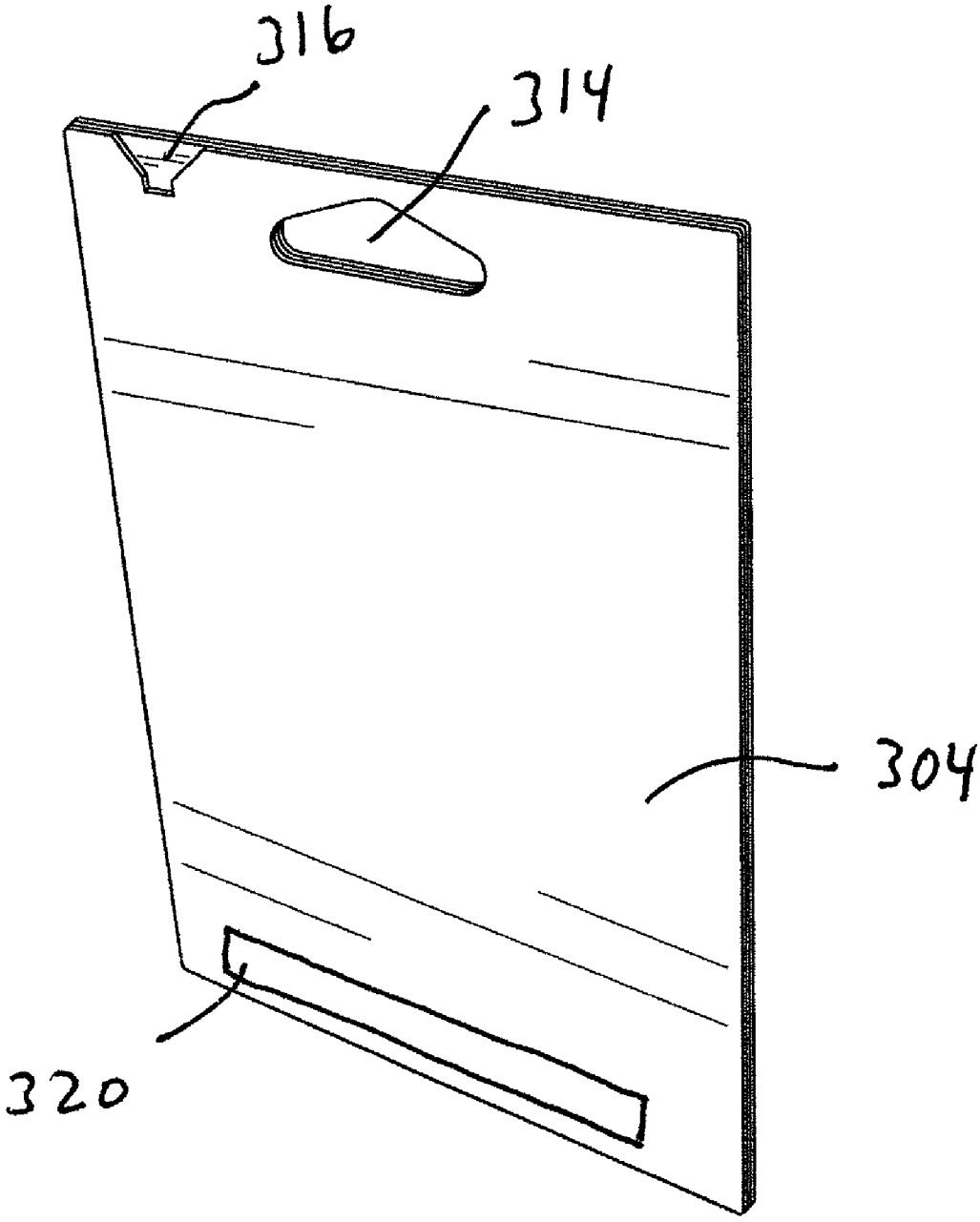
FIG. 11 is a rear perspective view of the packaging of FIG. 10.
Figure 12:
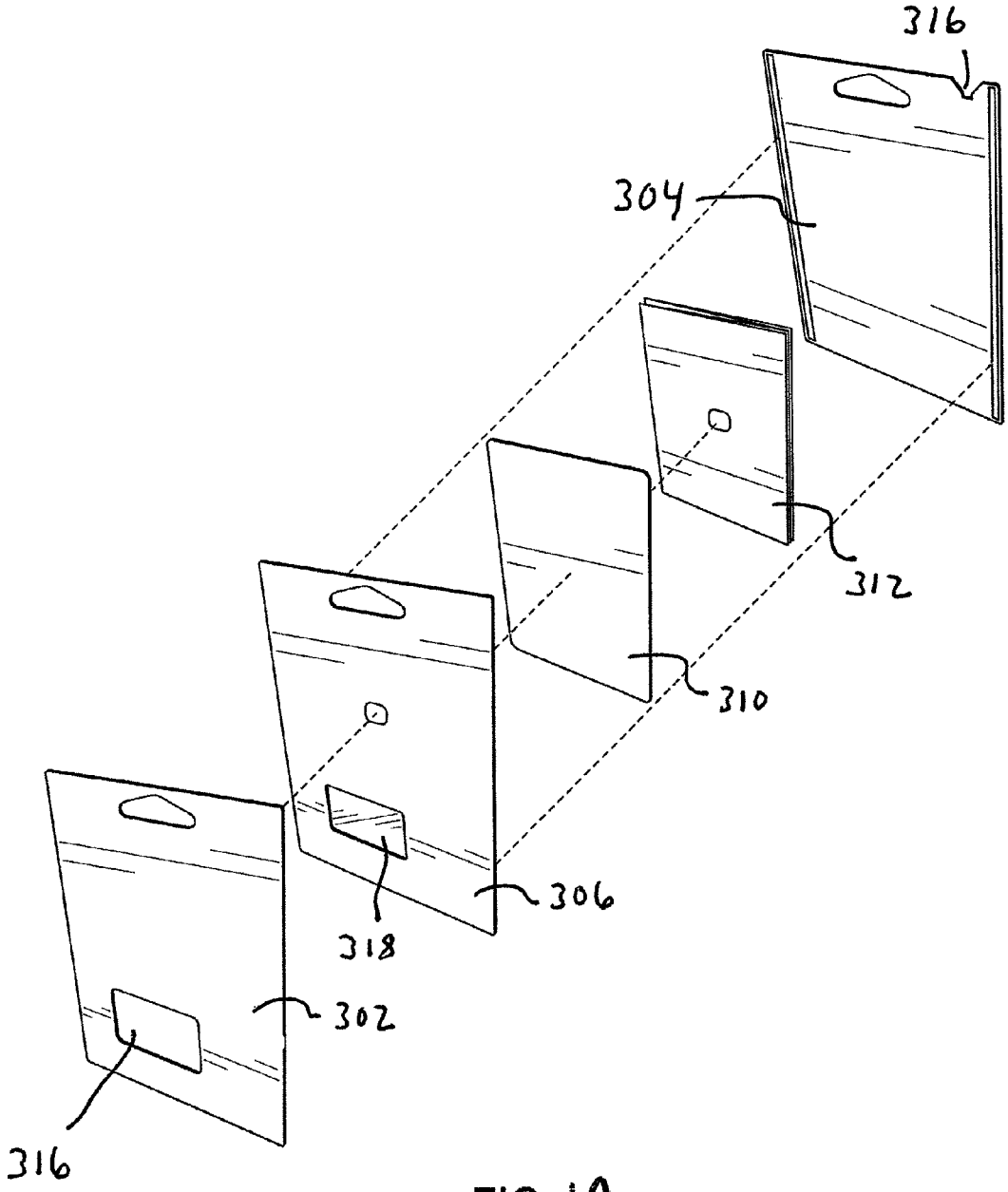
FIG. 12 is an exploded perspective view of the packaging of FIG. 10.

FIGS. 10-12 illustrate another embodiment of packaging 300 to house a transaction card 310. In this embodiment, the transaction card 310 (and optionally booklet 312) is held in place between rear panel 304 and inner panel 306. For example, the inner panel 306 may be glued along its periphery to rear panel 304 to retain the card 310 in place. The inner panel 306 preferably includes a window 318, for example, a cutout opening in the panel 306 covered in a transparent film to permit a portion of the transaction card 310 to be viewed from outside the package 300. A front panel 302 is affixed to the inner panel 306. The front panel 302 includes an opening 316 aligned with the window 318 to permit viewing access to the card 310. The transparent window 318 may be formed from any suitable material known in the art, such as any transparent plastic. The transaction card 310 is preferable placed and oriented within the window 318 so that certain data, text or other indicia is visible through the window, for example a holographic image and/or emblem associated with a transaction card 310 located in the packaging 300. The booklet 312 may contain full or temporary terms and conditions and/or other consumer-related material (how the transaction card works, how to activate it, how to use it, how to reload it, etc.).

As illustrated in FIG. 11, the rear panel 304 may include account activation indicia, such as a mag-stripe or variable bar code 320 (and possibly a universal price code), so that the transaction card 310 may be activated at the cash register when the retail package is purchased. The rear panel 304 may also include a tear strip 316 to facilitate opening the packaging 300 by the consumer to access the transaction card 310. An aperture 314 may be defined in each of the rear panel 304, the front panel 302, and the inner panel 306 for suspending the packaging 300 from a display peg or J-hook.

Figure 13:
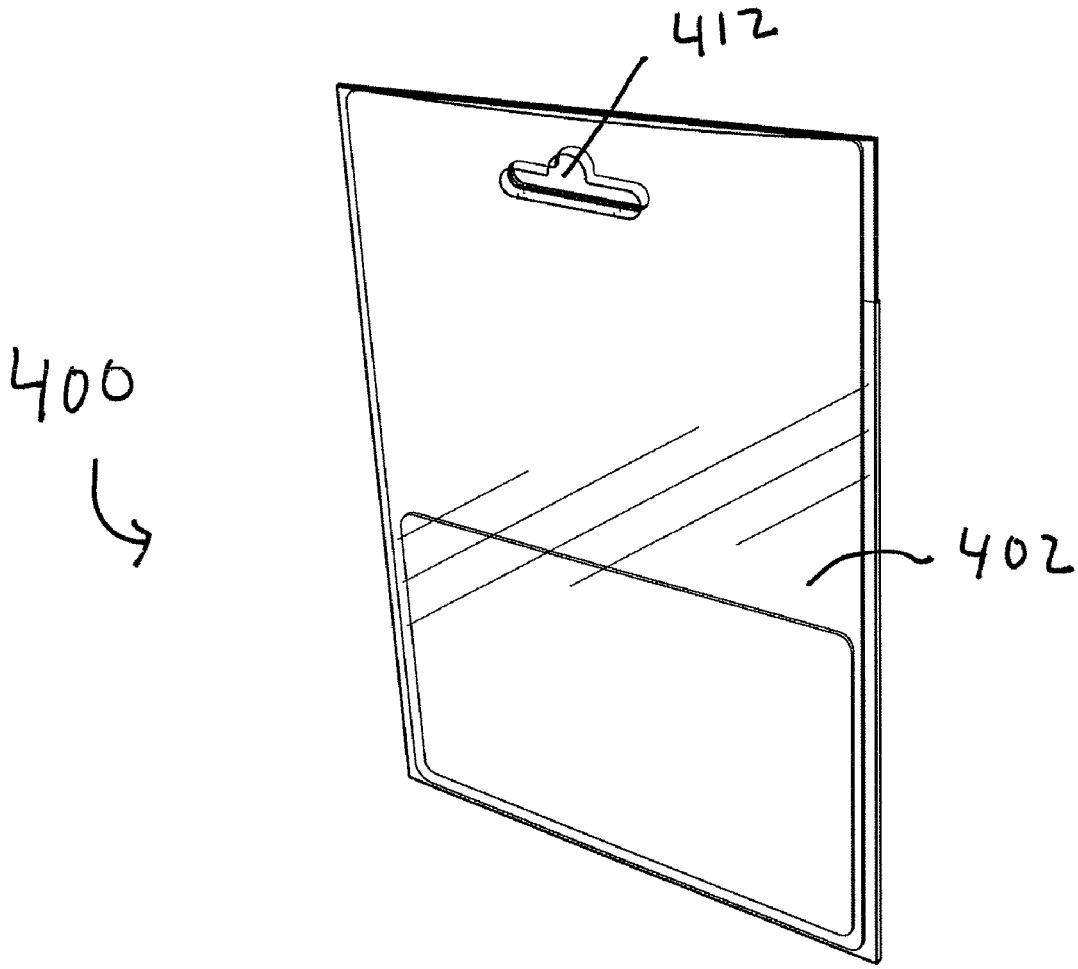
FIG. 13 is a front perspective view of the packaging for a transaction card in accordance with a fourth embodiment of the present invention.
Figure 14:
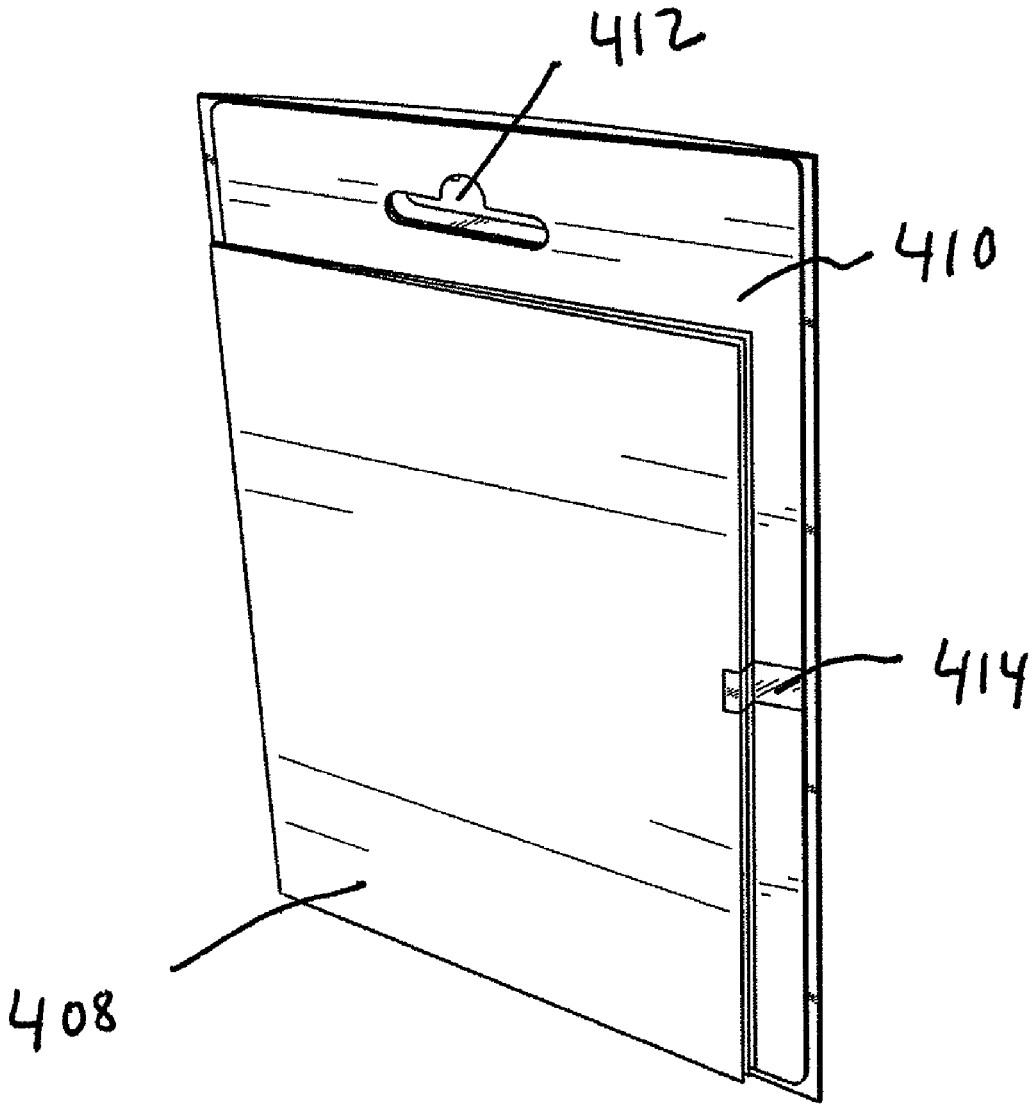
FIG. 14 is a rear perspective view of the packaging of FIG. 13.
Figure 15:
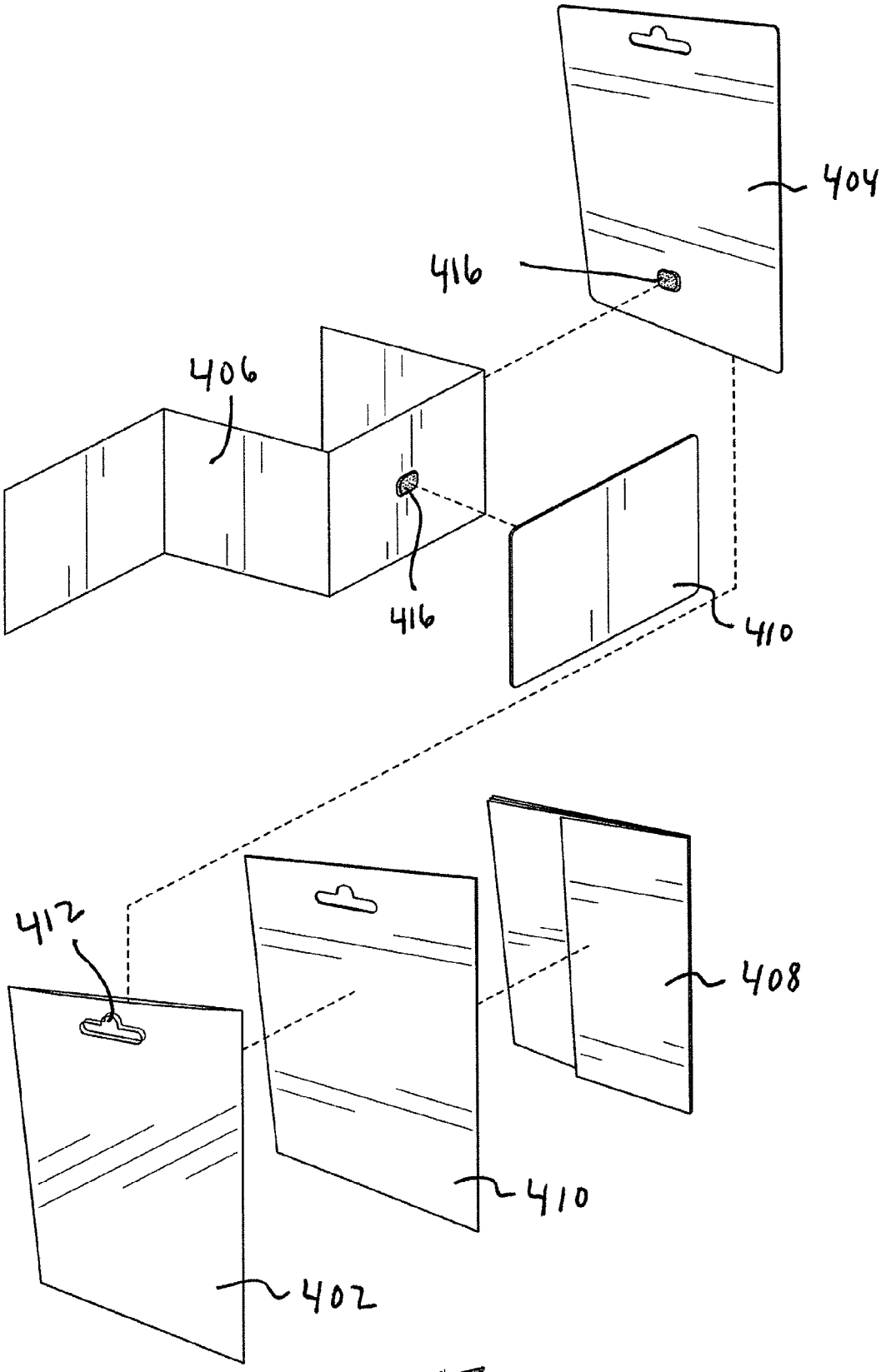
FIG. 15 is an exploded perspective view of the packaging of FIG. 13.
Figure 16:
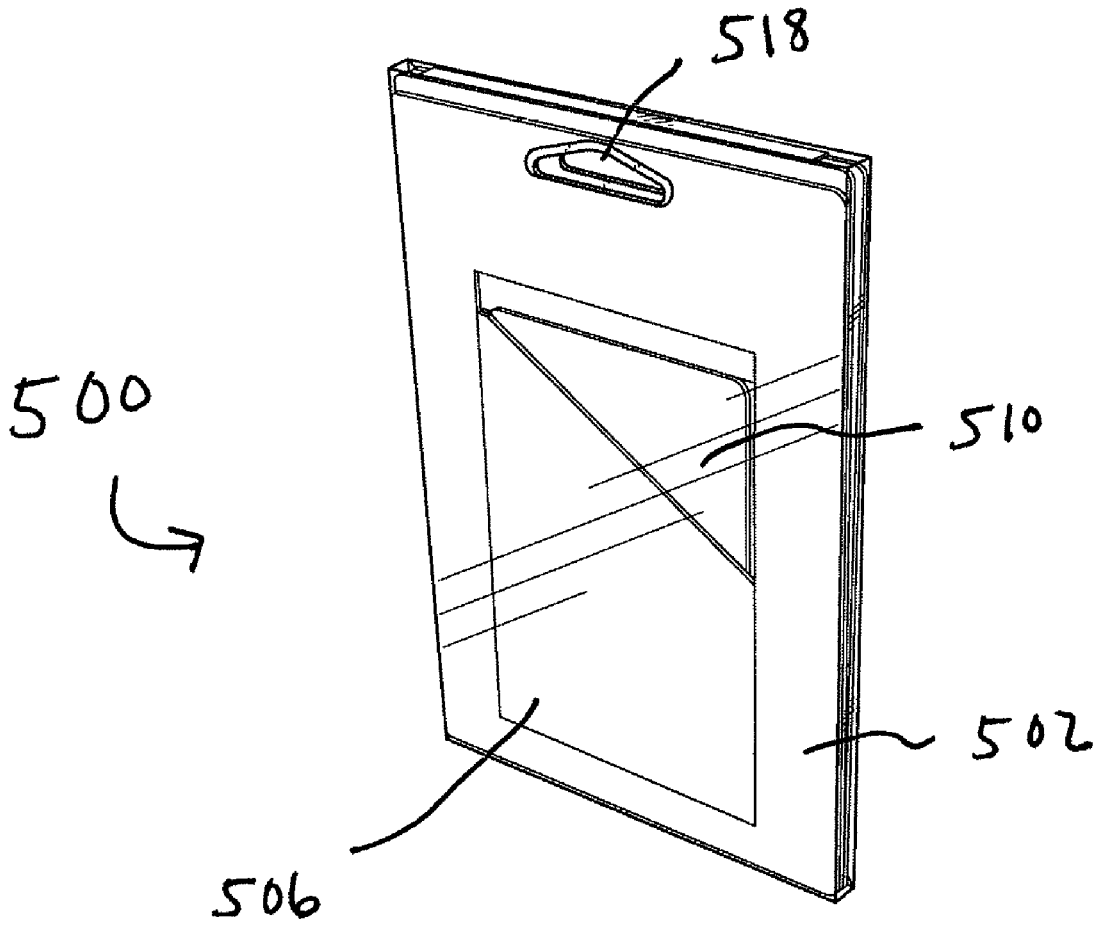
FIG. 16 is a front perspective view of the packaging for a transaction card in accordance with a fifth embodiment of the present invention.
Figure 17:
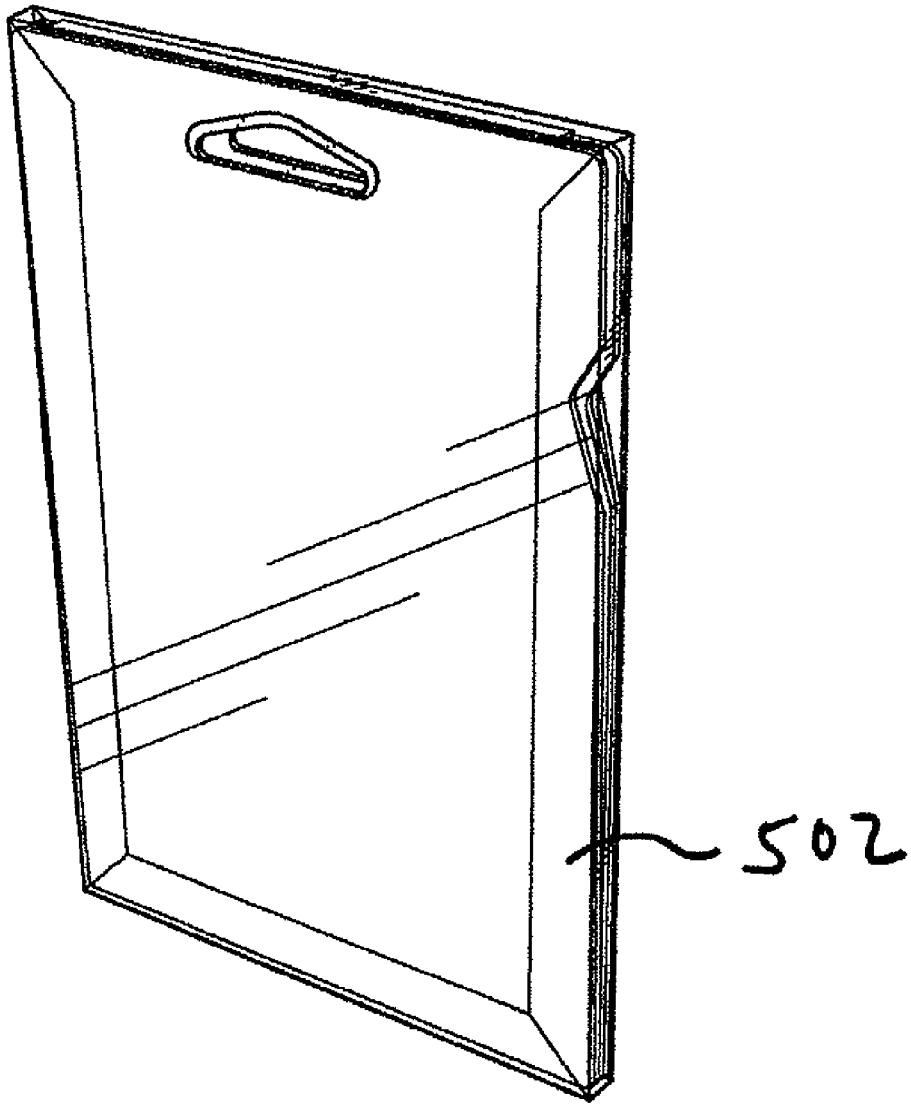
FIG. 17 is a rear perspective view of the packaging of FIG. 16.

FIGS. 13-15 illustrate a fourth embodiment of the retail packaging 400 for retaining a transaction card 410. The packaging 400, which may be sized as desired for retail display and security purposes, preferably includes a pouch 402 that is generally transparent and may be formed from clear, see-through or frosted plastic, although other forms are within the scope of the present invention. The pouch 402 is preferably sealed along its peripheral margin, for example, using a heat bond, an adhesive seal, a RF laser-based seal, UV heat glue, or other means customary in the packaging industry. In this embodiment, the pouch 402 provides protection against tampering and pilferage of the enclosed transaction card 410. A label may be included on the pouch 402 to partially obscure the enclosed retail card 410 from view and may include customary advertising and product information.

Upon purchase, the pouch 402 may be opened on its top end to permit access to the enclosed transaction card 410. The transaction card 410 may be adhered to an inner panel 404 (for example at adhesion points 416) along with, optionally, a booklet containing, for example, terms and conditions for use with the transaction card 410. The transaction card 410 may be oriented in any direction within the pouch 410. A second booklet 408 may be attached to the rear side of the pouch 402. This second booklet 408 may contain consumer-related material (how the transaction card works, how to activate it, how to use it, how to reload it, etc.). In order to provide further structural support to the packaging 400, the second booklet 408 may be adhered to the pouch 402 via an insert panel 410. The second booklet 408 may be retained in a closed position using, for example, tape 414. The packaging 400 may include an aperture 412 to allow the packaging 400 to be displayed on a hook in the retail setting.

FIGS. 16-22 illustrate another embodiment of packaging 500 to house a transaction card 510. This embodiment includes a clear plastic shell 502 housing a multi-panel carrier 504, to which is attached pouch 506 for retaining transaction card 510. The shell 502 and carrier 504 may include an aperture 518 to allow the packaging 400 to be displayed on a hook in the retail setting.

Figure 18:
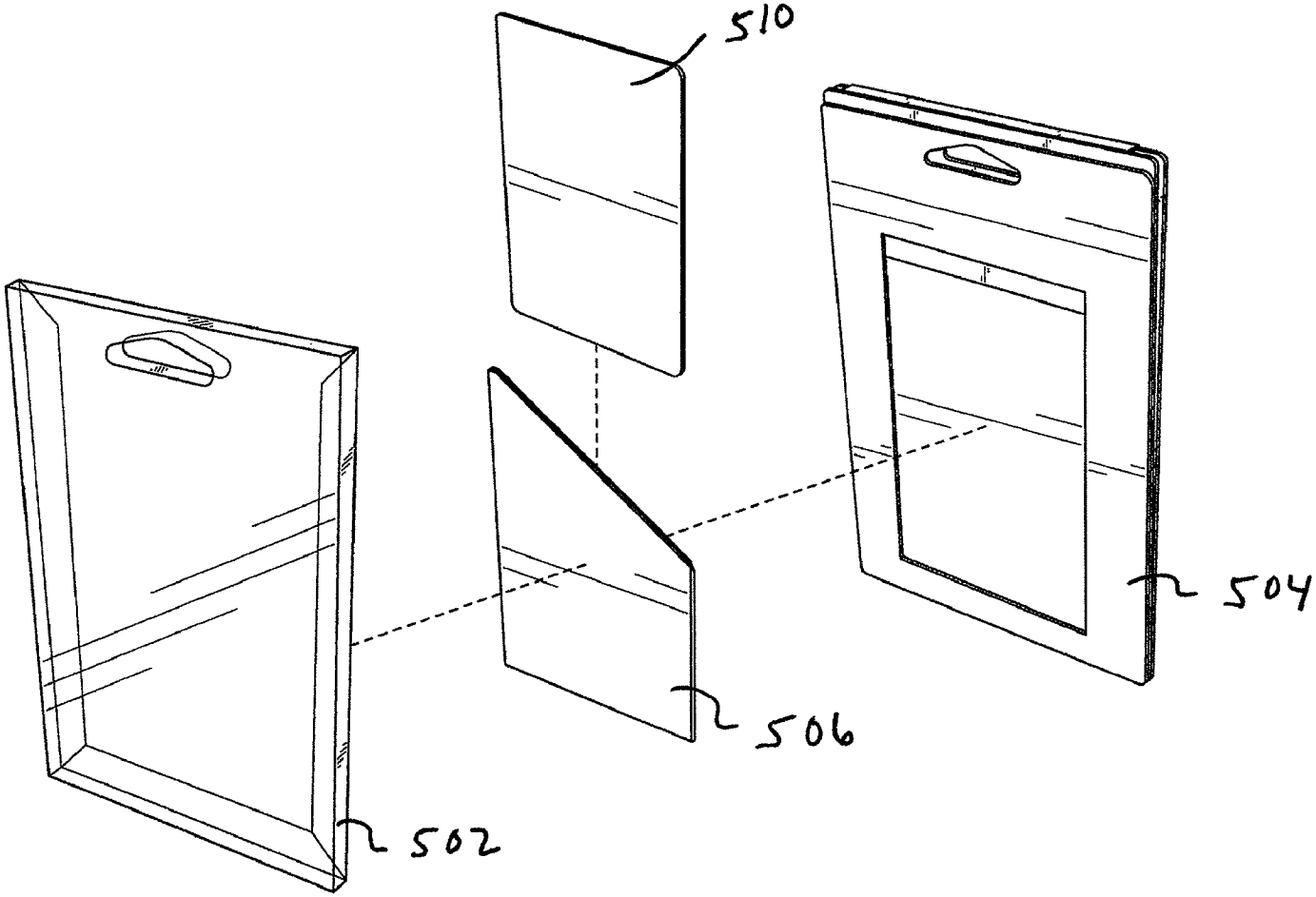
FIG. 18 is an exploded perspective view of the packaging of FIG. 16.
Figure 19:
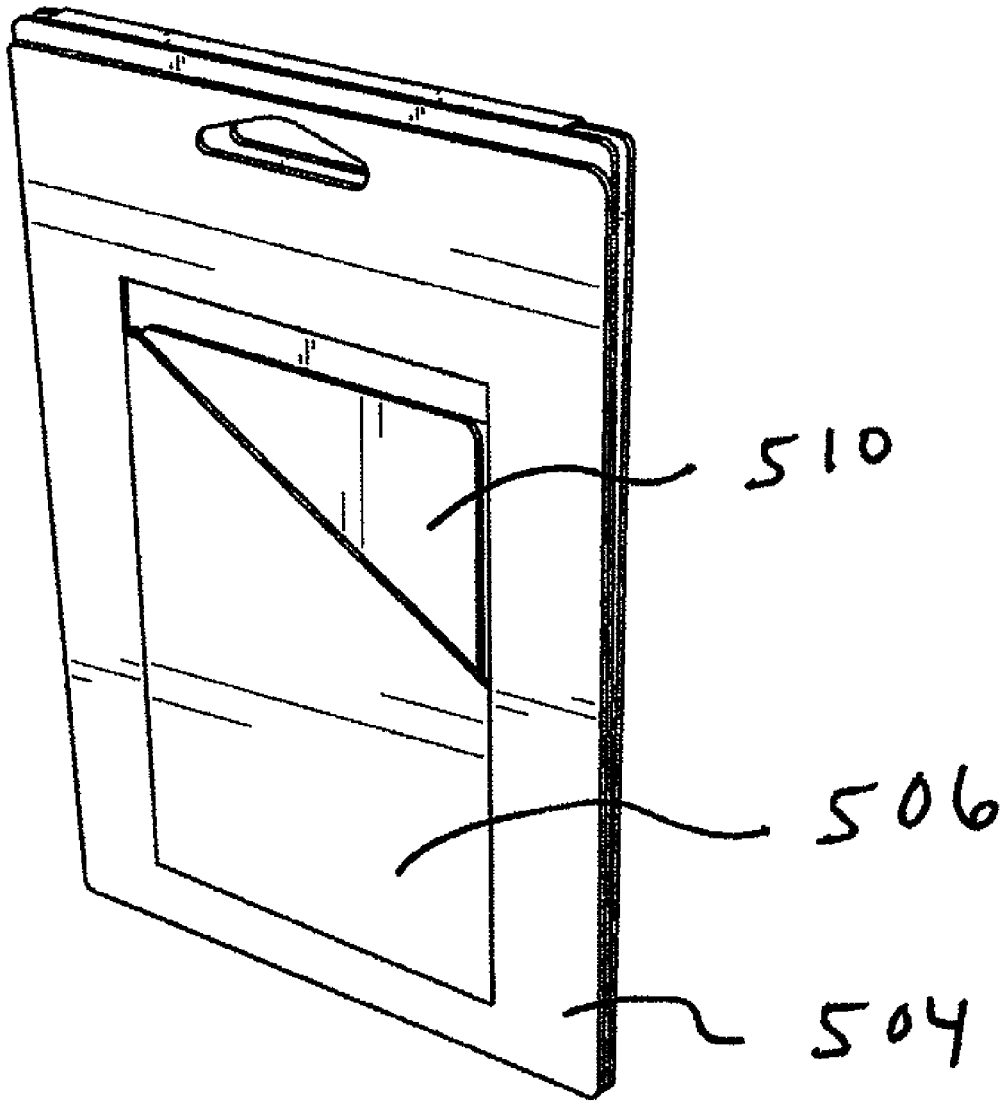
FIG. 19 is a front perspective view of the carrier of the packaging of FIG. 16.
Figure 20:
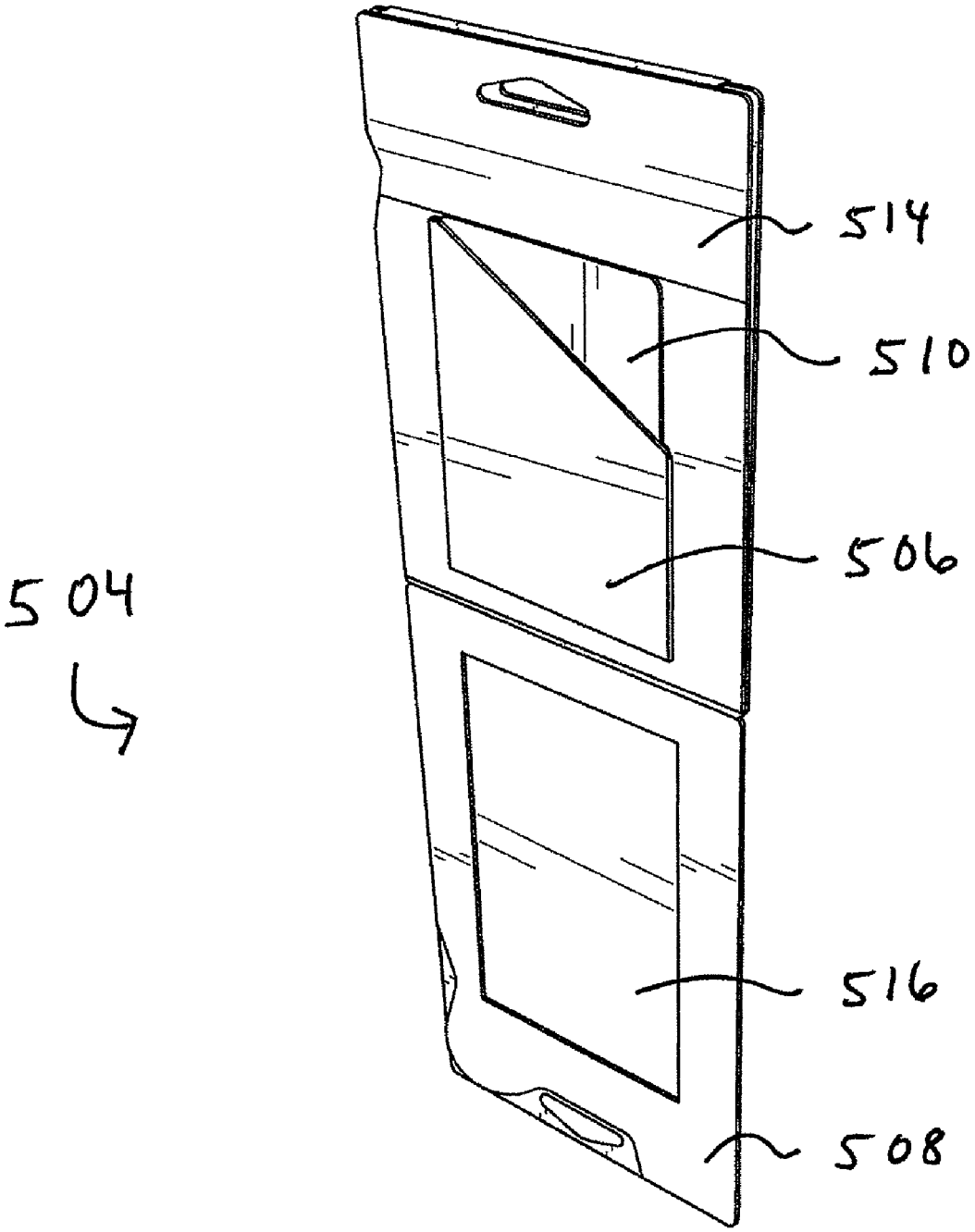
FIG. 20 is a front perspective view of the carrier of the packaging of FIG. 16 in a partially opened condition.
Figure 21:
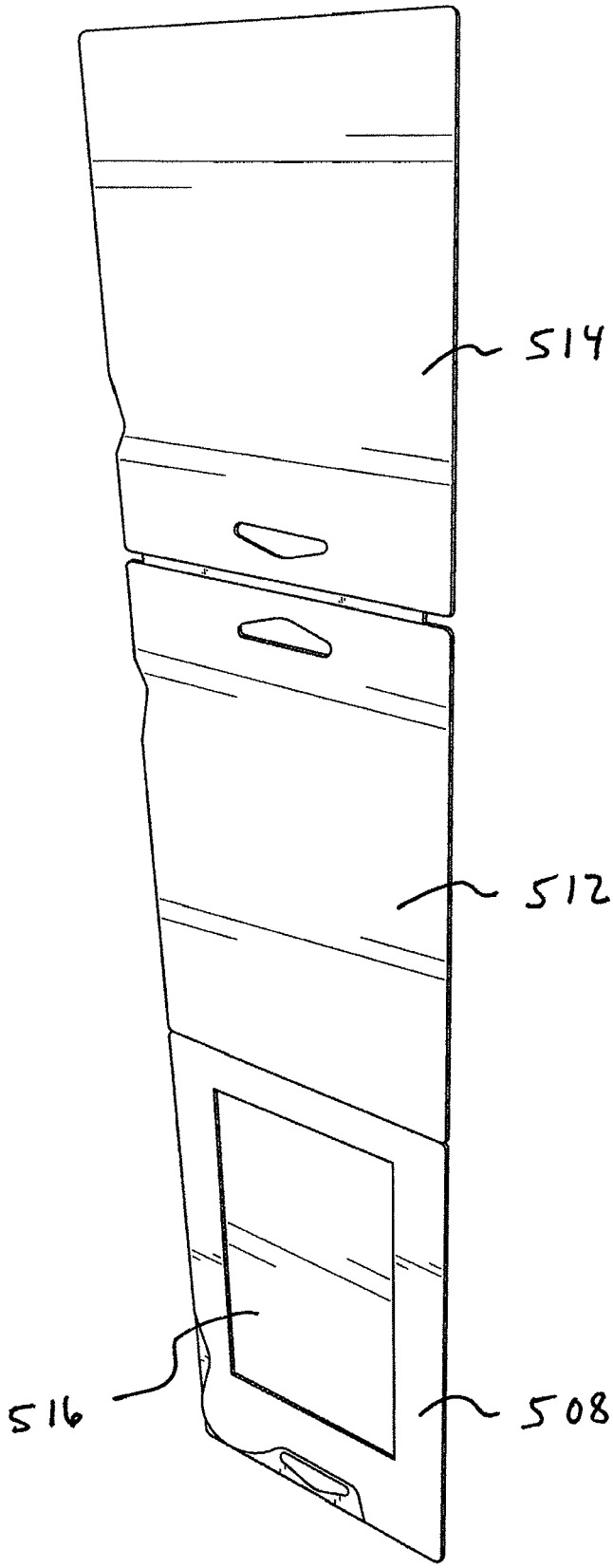
FIG. 21 is a front perspective view of the carrier of the packaging of FIG. 16 in a opened condition.
Figure 22:
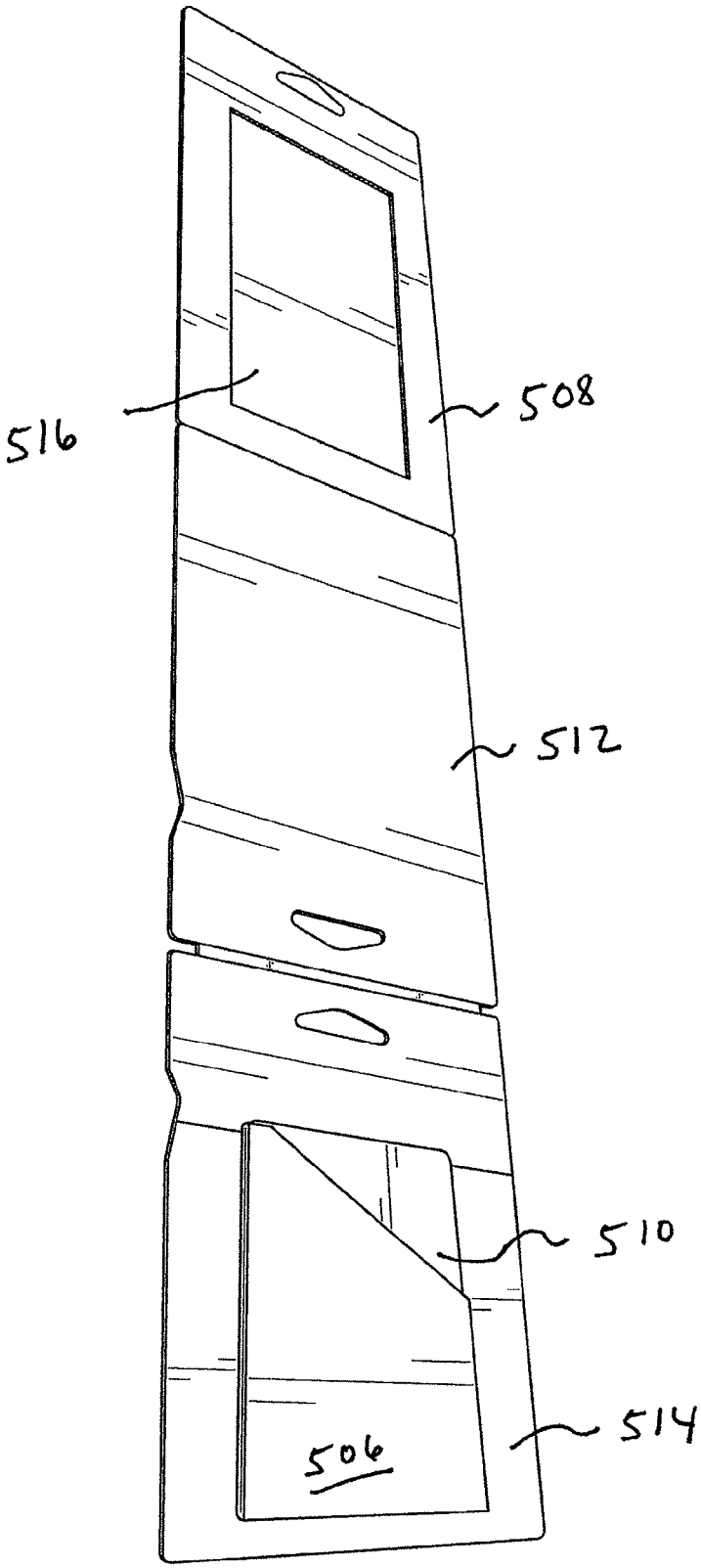
FIG. 22 is a rear perspective view of the carrier of the packaging of FIG. 16.

As illustrated in FIG. 18, the shell 502 is preferably formed from clear, see-through or frosted plastic, although other forms are within the scope of the present invention. For example, the shell 502 may be formed from a cut sheet of plastic folded over and sealed in the form of a rectangular container to house the carrier 504.

The carrier 504 includes central panel 514, rear panel 512, and front panel 508. The pouch 506, which may be formed, for example, by folding a sheet of cardboard is attached to the central panel 514. Thus, when used in a retail setting, the pouch 506 gives the transaction card 510 the appearance that it is floating within the carrier 504. The front panel 508 folds over the central panel 514 such that the opening 516 in the front panel 508 fits over the pouch 506.

The rear panel 508 may include account activation indicia, such as a mag-stripe or variable bar code, so that the transaction card 510 may be activated at the cash register when the retail package is purchased. A booklet containing terms and conditions and/or other consumer-related material may be included in between the central panel 514 and rear panel 508 when such panels are folded onto one another.

Figure 23:
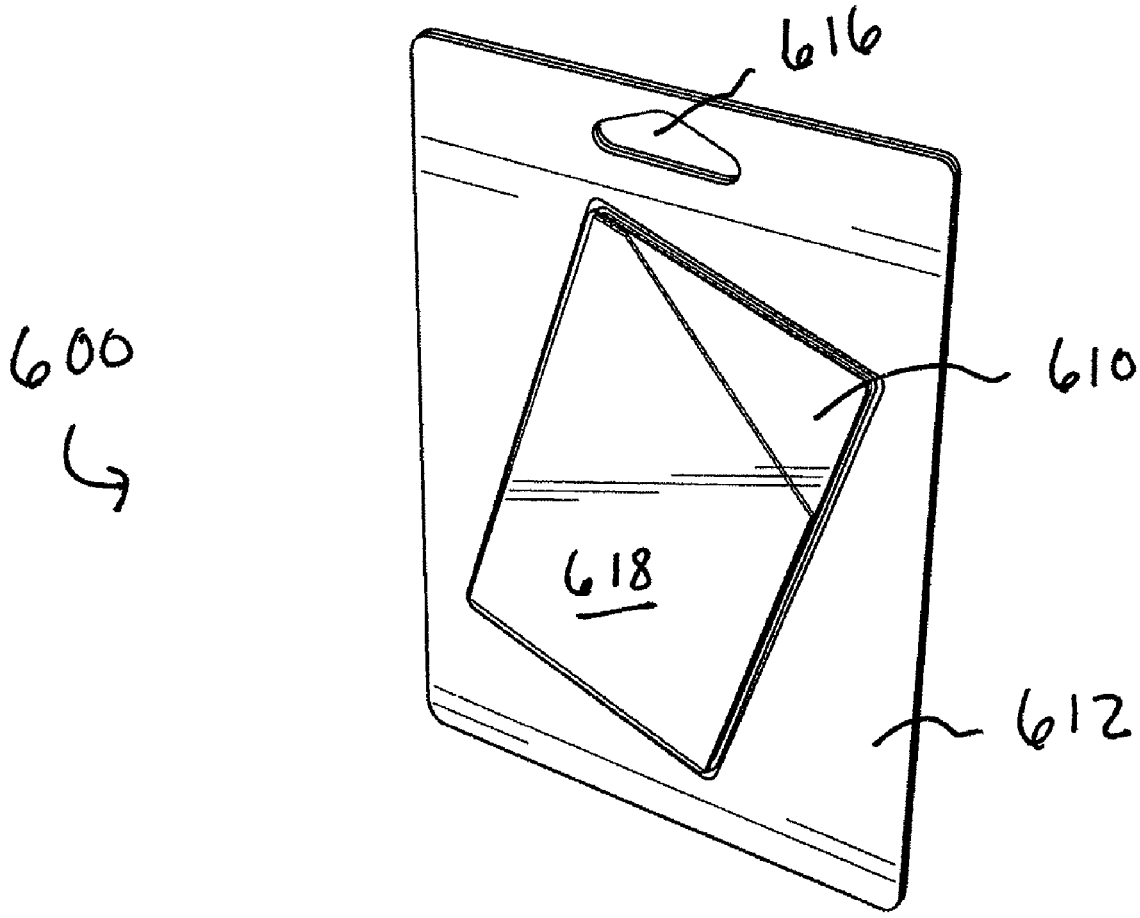
FIG. 23 is a front perspective view of the packaging for a transaction card in accordance with a sixth embodiment of the present invention.
Figure 24:
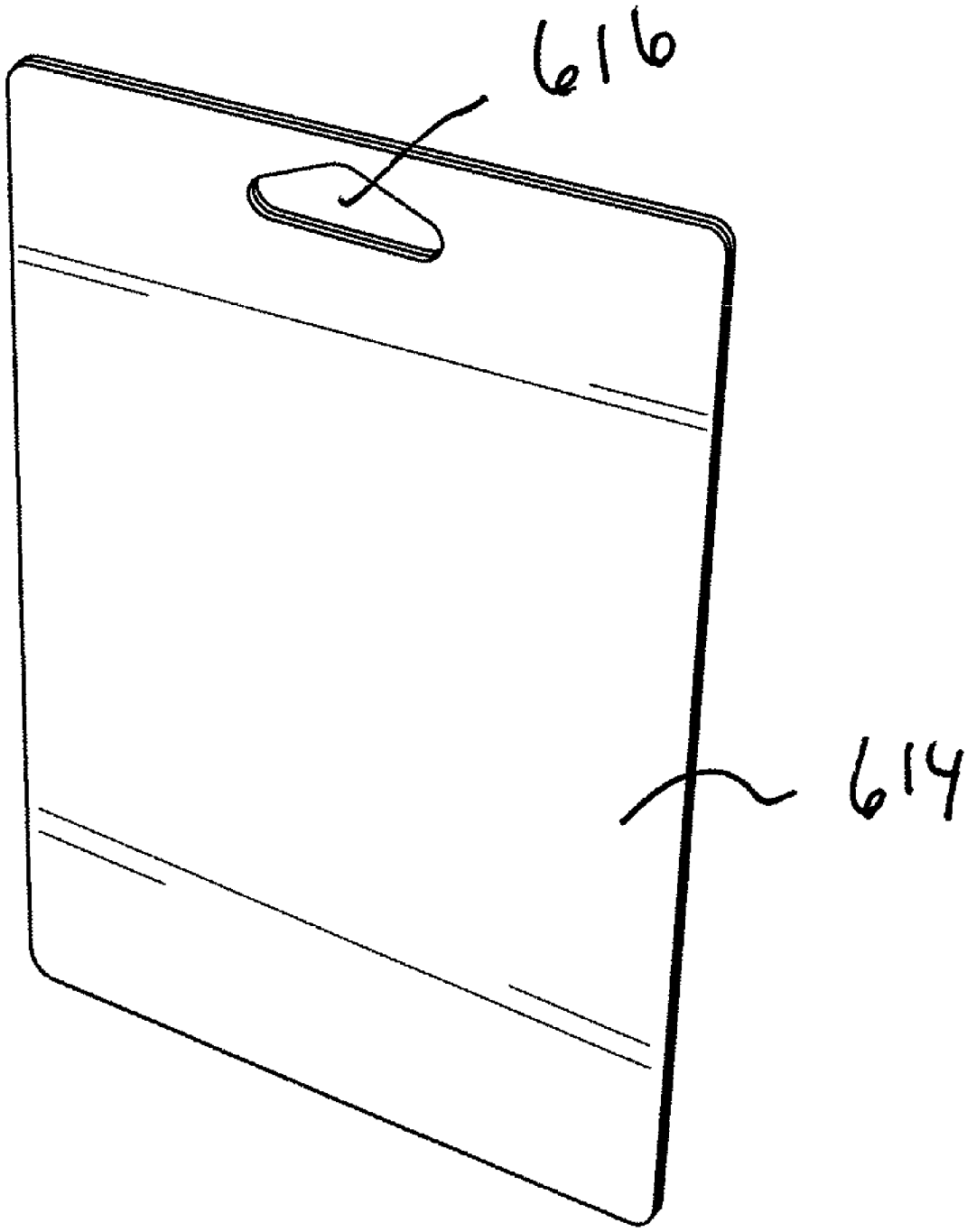
FIG. 24 is a rear perspective view of the packaging of FIG. 23.
Figure 25:
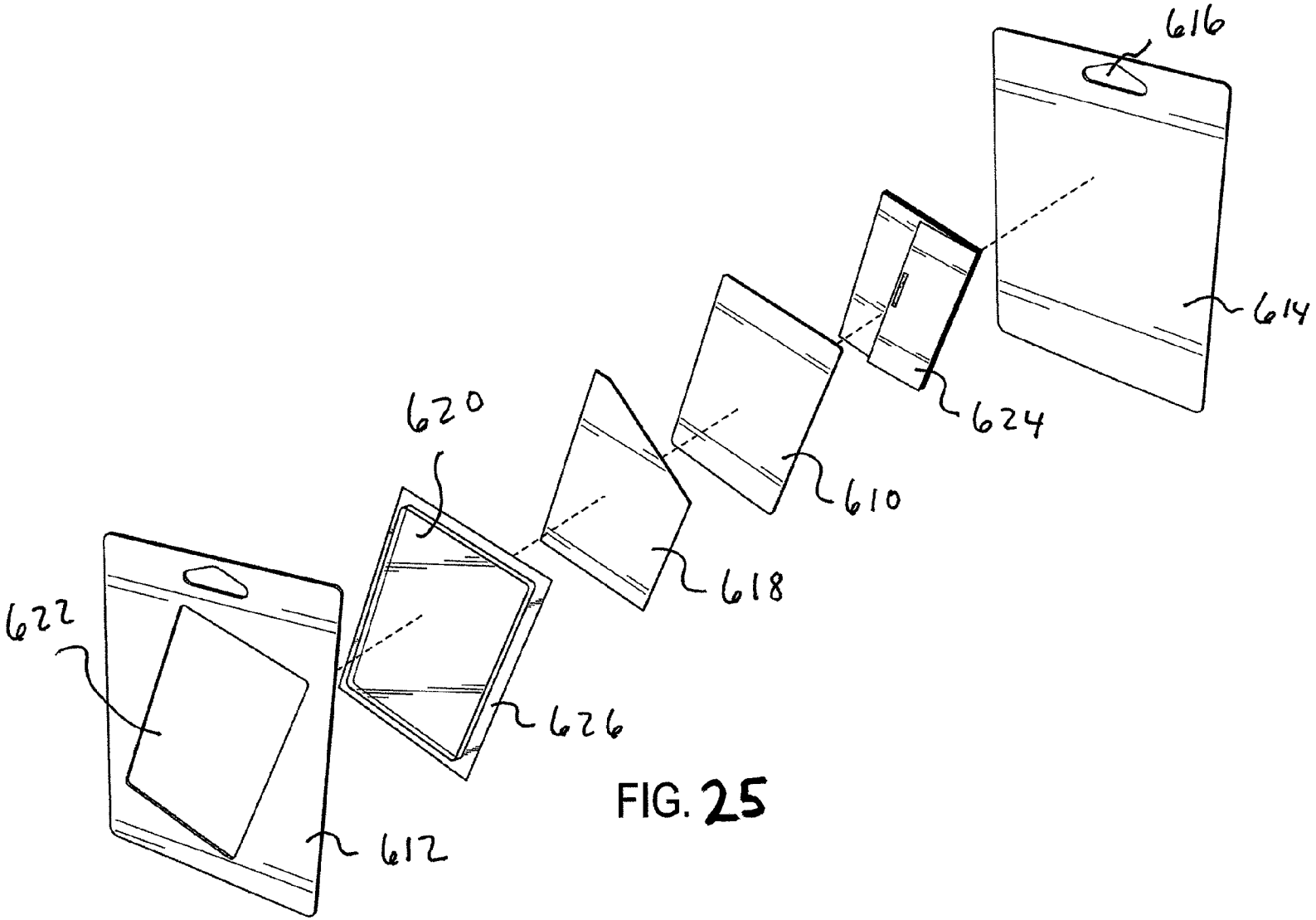
FIG. 25 is an exploded perspective view of the packaging of FIG. 23.

FIGS. 23-25 illustrate another embodiment of the packaging 600, which preferably includes shell 620, screen 618, transaction card 610, and booklet 624 sandwiched between front panel 612 and rear panel 614, which are then glued or otherwise adhered together. The front panel 612 and rear panel 614 may be formed from cardboard, laminated card or sheet stock, or the like, and include aperture 616 for placement on a hook. Shell 620 is preferably formed from a transparent sheet into a small cavity having a lip 626 designed to retain the shell 620 in the opening 622 in the front panel. The lip 626 of the shell 620 may be adhered to the inside of the front panel 612. The screen 618 (e.g., a sheet of cardboard), transaction card 610 and booklet 624 may be retained within the cavity of the shell 620. Preferably, the screen 618 is smaller in overall size than the transaction card 610 to permit some portion of the transaction card 610 be viewed when the packaging 600 is displayed in a retail setting. For example, as shown in FIGS. 23 and 25, the screen 618 may have one corner trimmed off to permit a triangular section of the transaction card 610 viewable.

Although certain illustrative embodiments and methods have been disclosed herein, it will be apparent from the foregoing disclosure to those skilled in the art that variations and modifications of such embodiments and methods may be made without departing from the spirit and scope of the invention. For example, although the embodiments shown herein are used in conjunction with transaction cards (e.g., an association-branded prepaid card, prepaid cards, debit cards, gift cards, etc.), the innovative retail packages disclosed herein may be used with other types of cards or merchandise. Accordingly, it is intended that the invention should be limited only to extent required by the appended claims and the rules and principals of applicable law.

The invention claimed is:

1. Packaging for transaction card comprising:

a carrier for retaining the transaction card; and a transparent encasement enclosing the carrier, the encasement comprising a front shell and a mating back shell, wherein the back shell comprises a cutout forming an opening when the front shell is mated with the back shell in a closed condition; and wherein the carrier comprises a main panel, a rear panel and a hinge panel attaching the rear panel to the main panel, the hinge panel extending through the opening such that the rear panel is located outside of the encasement.

2. The packaging of claim 1 wherein the front shell of the encasement comprises a curved outer surface forming a cavity within the encasement.

3. The packaging of claim 2 wherein the carrier comprises a main surface and a device for elevating the transaction card off the main surface to create a visual effect that the transaction card is floating within the encasement.

4. The packaging of claim 1 wherein the carrier comprises a panel that at least partially obscures the transaction card from view.

5. The packaging of claim 1 wherein the literature comprises a booklet containing terms and conditions associated with the use of the transaction card.

6. The packaging of claim 1 wherein the main panel comprises a flap foldable over the main panel, the main panel and the flap being enclosed within the encasement.

7. The packaging of claim 6 further comprising a transaction card affixed to the main panel and wherein the flap is smaller than the main panel such that when the flap is in a folded position the flap obscures a portion of the transaction card.

8. The packaging of claim 6 wherein the main panel, the rear panel, the hinge panel, and the flap are formed from a single sheet of card stock material.

* * * * *